US011524396B2

(12) United States Patent
Hegarty et al.

(10) Patent No.: US 11,524,396 B2
(45) Date of Patent: Dec. 13, 2022

(54) FASTENER TOOL

(71) Applicant: BLACK & DECKER, INC., New Britain, CT (US)

(72) Inventors: Daniel Hegarty, Baltimore, MD (US); Michael Justis, Towson, MD (US)

(73) Assignee: BLACK & DECKER, INC., New Britain, CT (US)

( * ) Notice: Subject to any disclaimer, the term of this patent is extended or adjusted under 35 U.S.C. 154(b) by 207 days.

(21) Appl. No.: 16/805,657

(22) Filed: Feb. 28, 2020

(65) Prior Publication Data

US 2020/0276690 A1 Sep. 3, 2020

Related U.S. Application Data

(60) Provisional application No. 62/812,109, filed on Feb. 28, 2019, provisional application No. 62/812,251, filed on Feb. 28, 2019.

(51) Int. Cl.

| | |
|---|---|
| ***B25C 1/00*** | (2006.01) |
| ***B25C 5/15*** | (2006.01) |
| ***B25C 1/06*** | (2006.01) |

(52) U.S. Cl.

CPC ..... *B25C 1/008* (2013.01); *B25C 1/06* (2013.01); *B25C 5/15* (2013.01)

(58) Field of Classification Search

CPC ..... B25C 1/008; B25C 1/06; B25C 5/15

See application file for complete search history.

(56) References Cited

U.S. PATENT DOCUMENTS

| | | | | |
|---|---|---|---|---|
| 2,351,044 A * | 6/1944 | Heller | B25C 5/06 227/77 |
| 2,351,045 A | 8/1944 | Heller | |
| 2,923,938 A | 2/1960 | Rinehardt | |
| 3,524,575 A * | 8/1970 | Hurkmans | B25C 5/0228 227/123 |
| 4,574,992 A | 3/1986 | Holman | |
| 4,598,852 A * | 7/1986 | Olesen | B25C 5/15 227/119 |
| 4,669,647 A | 6/1987 | Storace | |

(Continued)

FOREIGN PATENT DOCUMENTS

| | | |
|---|---|---|
| DE | 3641477 | 6/1988 |
| JP | 2013-111719 | 6/2013 |

*Primary Examiner* — Joshua G Kotis
*Assistant Examiner* — Katie L Gerth
(74) *Attorney, Agent, or Firm* — Pillsbury Winthrop Shaw Pittman LLP

(57) ABSTRACT

A tool is provided for applying fasteners to a workpiece. The tool as a magazine that carries multiple fasteners and is carried by a housing. A driver blade is provided to drive a lead fastener into a workpiece. The driver blade has a driving edge with a profile that includes driving projections, having curved contact surface for contact with curved edges of the fastener, and a relief portion therebetween that is recessed relative to both projections and contact surfaces. Further, the tool includes a lockout assembly for limiting movement of the driver blade and contact trip, thereby limiting activation of the motor. The pusher may include a pusher lockout surface that is designed for movement in an opposite direction to a feed direction by the contact trip as well as configured to slide over a locking art of the contact trip when the fasteners are empty or nearly empty.

20 Claims, 38 Drawing Sheets

(56) References Cited

U.S. PATENT DOCUMENTS

| | | | | |
|---|---|---|---|---|
| 4,747,531 | A | 5/1988 | Brinkerhoff et al. | |
| 5,180,091 | A | 1/1993 | Ota | |
| 5,846,019 | A | 12/1998 | Kuhns | |
| 5,941,440 | A | 8/1999 | Ohmae | |
| 5,941,652 | A | 8/1999 | Kuhns | |
| 6,071,053 | A | 6/2000 | Kuhns | |
| 6,371,352 | B1 | 4/2002 | Mochizuki | |
| 6,592,014 | B2 | 7/2003 | Smolinski | |
| 6,899,258 | B2 | 5/2005 | Haramiishi | |
| 6,918,524 | B1 | 7/2005 | Mochizuki et al. | |
| 6,966,476 | B2 | 11/2005 | Jalbert et al. | |
| 7,011,242 | B2 | 3/2006 | Barlow | |
| 7,014,084 | B2 | 3/2006 | Mochizuki et al. | |
| 7,182,236 | B1 | 2/2007 | Wen | |
| 7,243,830 | B2 | 7/2007 | Kitamura et al. | |
| 7,296,720 | B2 | 11/2007 | Kirby et al. | |
| 7,506,787 | B2 | 3/2009 | Wu et al. | |
| 7,510,106 | B2 | 3/2009 | Manabe | |
| 7,600,661 | B2 | 10/2009 | Adachi | |
| 7,918,374 | B2 * | 4/2011 | Gardner | F16B 15/0015 227/130 |
| 7,980,439 | B2 | 7/2011 | Akiba et al. | |
| 8,047,414 | B2 | 11/2011 | Kunz et al. | |
| 8,104,658 | B2 | 1/2012 | Yu | |
| 8,292,143 | B2 | 10/2012 | Lee et al. | |
| 8,336,750 | B2 | 12/2012 | Maemori | |
| 8,567,654 | B2 | 10/2013 | Wu et al. | |
| 9,498,871 | B2 | 11/2016 | Gregory et al. | |
| 9,505,116 | B2 | 11/2016 | Wong | |
| 9,643,305 | B2 | 5/2017 | Gregory et al. | |
| 9,649,755 | B2 | 5/2017 | Gregory et al. | |
| 9,827,658 | B2 | 11/2017 | Gregory et al. | |
| 2003/0115738 | A1 * | 6/2003 | Barlow | F16B 15/0092 29/592 |
| 2003/0121948 | A1 | 7/2003 | Hsien | |
| 2006/0231582 | A1 * | 10/2006 | Hong | B25C 5/1651 227/109 |
| 2010/0288815 | A1 * | 11/2010 | Maemori | B25C 5/11 227/127 |
| 2017/0368711 | A1 * | 12/2017 | Luttich | B27F 7/36 |
| 2018/0071904 | A1 | 3/2018 | Gregory et al. | |
| 2018/0085904 | A1 | 3/2018 | Gregory et al. | |
| 2018/0093370 | A1 * | 4/2018 | Yip | B25C 1/008 |

* cited by examiner

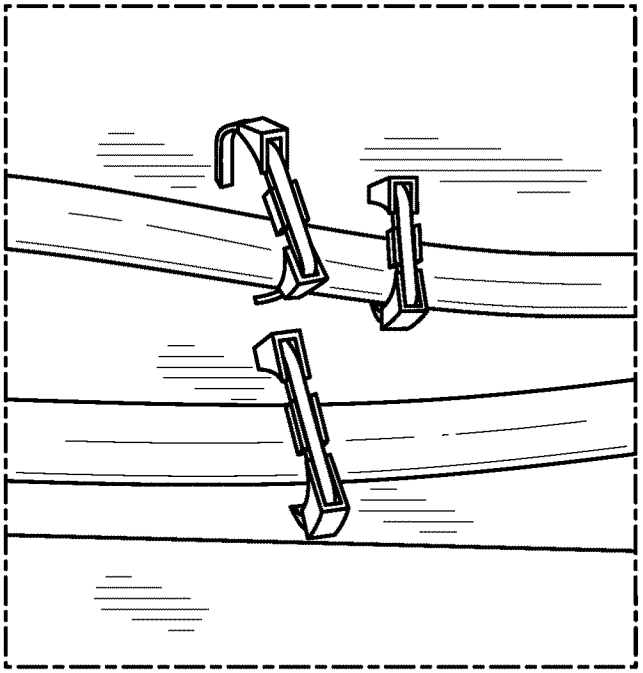
FIG. 2 - TJI
PRIOR ART
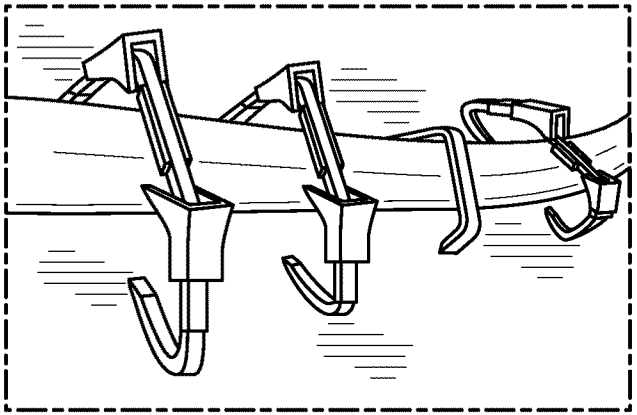
FIG. 1 - Southern Yellow Pine
PRIOR ART

FASTENER TOOL

CROSS REFERENCE TO RELATED APPLICATIONS

This application claims priority to U.S. Provisional Patent Application No. 62/812,109, filed Feb. 28, 2019, and U.S. Provisional Patent Application No. 62/812,251, filed Feb. 28, 2019, the contents of all being hereby incorporated by reference in their entireties.

FIELD

This disclosure relates, in general, to the field of power tools. In particular, the disclosure relates to portable fastening or driving tools, such as a nailers and staplers, and more particularly to improvements in such tools for driving a fastener into a workpiece.

DESCRIPTION OF RELATED ART

Existing fastening tool driver blades for fasteners, such as staples, have a flat profile. The flat profile in certain applications causes the staple legs to bow outwards and/or buckle when a force is applied to the crown of the staple. See, e.g., FIGS. 1, 2 and 3A-3C. Because the crown of a staple is bowed (and not flat), a flat profile driver blade exerts a driving force on a center of the crown, between the legs of the staple. The buckling of a staple is particularly a problem in the application for stapling cables to a workpiece, where it is generally desirable for the staple legs to be driven into and remain straight within a workpiece.

In this regard, embodiments of this disclosure are directed to a staple driver blade having a staple relief in the form of a staple driver having a scalloped blade profile.

Moreover, when a magazine of the fastening tool has zero fasteners (i.e., it is empty) or is nearly empty of fasteners, activating or firing such a tool may cause harm to the tool. In particular, when there are no fasteners to eject, undesired energy may be expended from the tool by actuating the driver blade and contact trip. In addition, movement of the driver blade within the housing of the tool may cause damage to an electrical cable during a firing operation when there is no fastener present to absorb drive energy. When the tool expends such energy, the life of the tool can be reduced.

In this regard, embodiments of this disclosure are directed to a lockout assembly disposed within a tool, such as a fastening tool, that provides a user of the tool an effective way to ensure that the tool does not fire if there are no fasteners, or a limited number of fasteners remaining in the magazine.

SUMMARY

It is an aspect of this disclosure to provide a tool including: a housing and a magazine carried by the housing. The magazine is configured to hold a plurality of fasteners and configured to present a lead fastener of the plurality of fasteners into a drive channel. Also, a driver blade is provided in the housing and configured for movement within the drive channel to drive the lead fastener into a workpiece, and a drive system is configured to drive the movement of the driver blade. The driver blade has a driving edge configured for contact with the lead fastener. The driving edge has: a pair of driving projections each configured for contact with curved edges of either side of the lead fastener above its legs, and a relief portion. Each of the driving projections have a driving contact surface. At least a portion of each of the driving contact surfaces has a curvature. The driving contact surfaces are configured to contact the curved edges of the lead fastener. The relief portion is provided between the pair of driving projections. The relief portion is recessed relative to both of the driving contact surfaces of the pair of driving projections.

Another aspect of this disclosure provides a tool including: a housing and a magazine carried by the housing. The magazine is configured to hold a plurality of fasteners and configured to present a lead fastener of the plurality of fasteners into a drive channel. Also, a driver blade is provided in the housing and configured for movement within the drive channel to drive the lead fastener into a workpiece, and a drive system is configured to drive the movement of the driver blade. The driver blade has a driving edge configured for contact with the lead fastener. The driving edge has: a pair of driving projections each configured for contact with curved edges of either side of the lead fastener above its legs, a pair of driving contact surfaces, and a relief portion. At least a portion of each of the driving contact surfaces has a curvature, and the driving contact surfaces are configured to contact the curved edges of the lead fastener. The relief portion is provided between the pair of driving projections and in a center of the driving edge. The relief portion is recessed relative to both of the driving contact surfaces and the pair of driving projections.

Yet another aspect of this disclosure provides a tool including: a housing and a magazine carried by the housing. The magazine is configured to hold a plurality of fasteners. A pusher is also associated with the magazine and is configured to move in a feed direction to present a lead fastener of the plurality of fasteners within the magazine into a drive channel. A driver blade is provided in the housing and configured for movement within the drive channel to drive the lead fastener into a workpiece, and a drive system is configured to drive the movement of the driver blade. A contact trip assembly is configured to be activated such that the driver blade drives the lead fastener into a workpiece. The contact trip assembly has a contact trip member configured for movement relative to the housing upon application of force thereto between a rest position and an enabled position that causes activation of the motor. The contact trip member has at least one lock surface, and the pusher has at least one pusher lockout surface. When the contact trip member moves from the enabled position to the rest position, the at least one lock surface is configured to push the pusher via the at least one pusher lockout surface away from the drive channel in an opposite direction to the feed direction. Further, when the magazine is empty or nearly empty of fasteners, the at least one pusher lockout surface is configured to move relative to the at least one lock surface of the contact trip member to limit movement of both the driver blade and the contact trip member.

Still yet another aspect of this disclosure provides a tool including: a housing and a magazine carried by the housing. The magazine configured to hold a plurality of fasteners. A spring-loaded pusher is associated with the magazine that is configured to move in a feed direction to present a lead fastener of the plurality of fasteners within the magazine into a drive channel. A driver blade is provided in the housing and configured for movement within the drive channel to drive the lead fastener into a workpiece, and a drive system is configured to drive the movement of the driver blade. A contact trip assembly is configured to be activated such that the driver blade drives the lead fastener into a workpiece. The contact trip assembly has a contact trip member configured for movement relative to the housing upon application of force thereto between a rest position and an enabled position that causes activation of the motor. The contact trip member has at least one lock surface, the lock surface being provided on an arm that extends laterally relative to a body of the contact trip member. The pusher has at least one pusher lockout surface provided on a pusher arm extending forwardly from a pusher body in the feed direction. The pusher is configured to limit movement of the driver blade within the drive channel when the contact trip member is in the rest position. When the contact trip member moves from the enabled position to the rest position, the at least one lock surface is configured to push the pusher via the at least one pusher lockout surface away from the drive channel in an opposite direction to the feed direction. Further, when the magazine is empty or nearly empty of fasteners, the at least one pusher lockout surface is configured to move relative to the at least one lock surface of the contact trip member to limit movement of both the driver blade and the contact trip member.

Other aspects, features, and advantages of the present disclosure will become apparent from the following detailed description, the accompanying drawings, and the appended claims.

BRIEF DESCRIPTION OF THE DRAWINGS

The numerous advantages of this disclosure may be better understood by those skilled in the art by reference to the accompanying Figures. In the drawings, like reference numerals designate corresponding parts throughout the several views.

FIGS. 1 and 2 illustrate buckling staples in accordance with staplers using standard or existing blades according to the prior art.

Corresponding reference numerals indicate corresponding parts throughout the several views of the drawings.

DETAILED DESCRIPTION OF THE PREFERRED EMBODIMENT(S)

This disclosure relates, in general, to the field of power tools. For example, this disclosure relates to portable fastener or driving tools, such as a nailers and staplers, and improvements made therein to both driving capabilities and safety features associated therewith. In particular, a driving edge of the driver blade used to drive fasteners has an updated profile which improves insertion of leg(s) of a driven fastener into a workpiece, as well as reduces and/or prevents buckling the leg(s). Further, risk of harm to the tool may be significantly reduced via a lockout assembly that does not allow the tool to actuate the driver blade and the contact trip when there are zero, or close to zero, fasteners remaining in the magazine. In an embodiment, the disclosed fastening tool can be a stapler and the fastener can be a staple.

Figure 4:
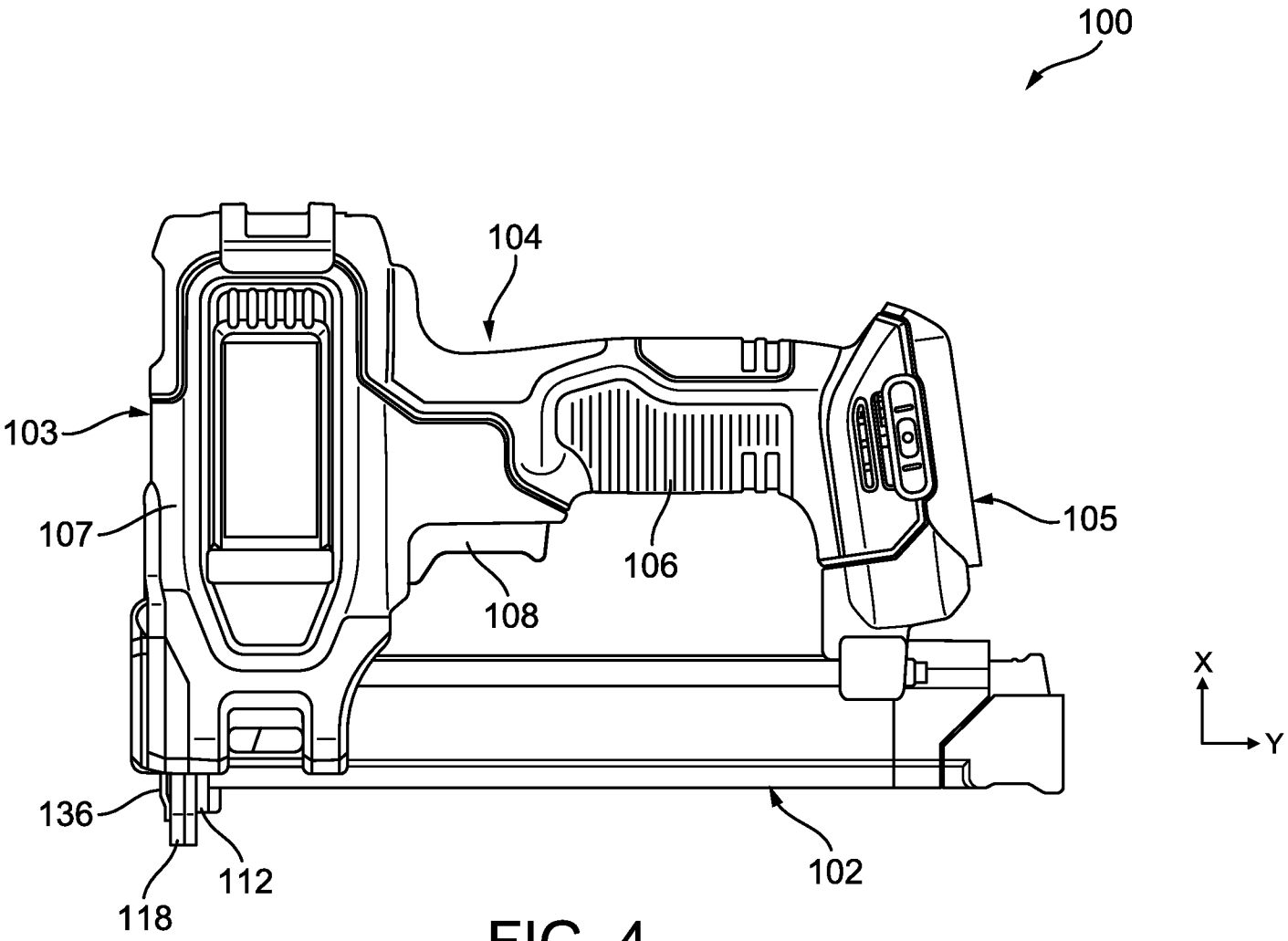
FIG. 4 illustrates a side view of a portable fastening driving tool having a fastener driver according to an embodiment of this disclosure.

FIG. 4 illustrates an embodiment of a fastener driving tool 100 that is adapted to drive fasteners into a workpiece. The fasteners may be U-shaped staples, brads, nails, and the like. The tool 100 may be a cordless power tool, in accordance with an embodiment. In one embodiment, the tool 100 is a stapler configured to drive staples into a workpiece.

The tool 100 includes a magazine 102 that holds a plurality of fasteners or staples that are configured to be dispensed from the tool 100 with sufficient energy to penetrate a workpiece. As shown, the example fastener driving tool 100 is a battery-powered stapler with a magazine 102 that holds a plurality of staples. The magazine 102 (via its parts therein) is generally configured to present a lead fastener F (e.g., see FIG. 36) of the plurality of fasteners into a drive channel 114 of the tool 100. As can be appreciated, the principles, technologies and structures described herein can also be used on other fastening devices including electric or pneumatic staplers, nailers, and the like. Further, the term "fastener" herein is intended to include staples, nails, and the like. In some instances throughout this disclosure, fastener and staple may be used interchangeably.

Figure 5:
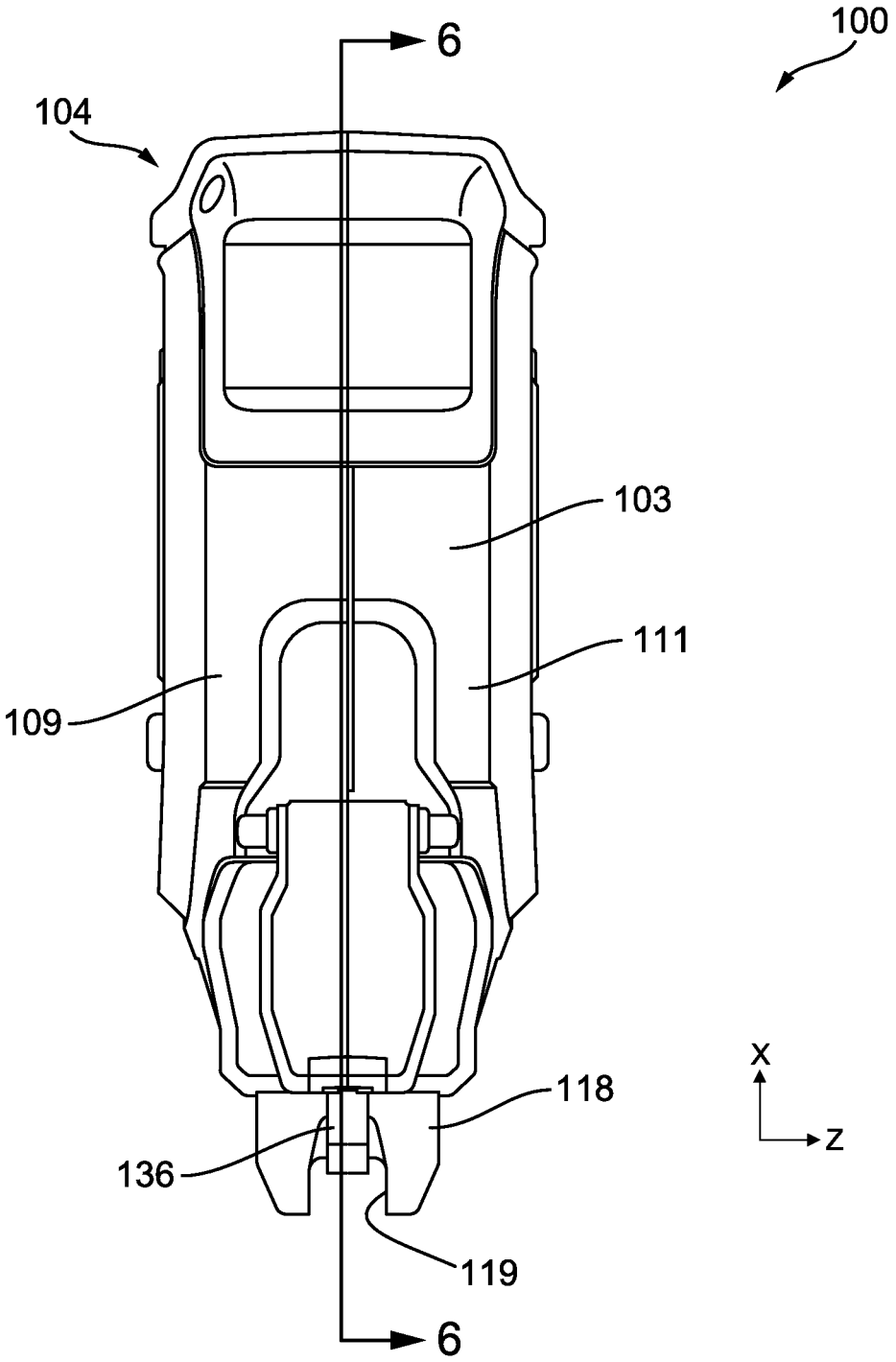
FIG. 5 illustrates a front view of the tool in FIG. 4.

The tool 100 includes a housing 104 or body portion that holds the magazine 102. The magazine 102 may be provided at a base portion 101 of the tool 100, in accordance with an embodiment. The housing 104 has a front end 103 and a back end 105. The housing 104 may include a handle 106 adapted to be gripped by the hand of an operator or user, and a vertical section 107 extending forwardly and downwardly (e.g., at the front end 103) from a forward end of the handle 106. In an embodiment, the housing 104 may be formed from molded parts. As generally represented in FIG. 5, for example, in one embodiment, a first side part 109 and a second side part 111 of the housing 104 may be molded and joined together to encapsulate parts of the fastener driving mechanisms (described in greater detail later) within the housing 104.

The housing 104 may include a trigger 108, adjacent to or on the handle 106, and a power unit 110 (which is part of a drive system), contained in the vertical section 107, that is configured to eject fasteners or staples from the magazine 102 at a nose 112. The nose 112 is provided at the base portion 101 of the tool. At least the nose 112, if not substantially the entire base portion of the tool 100, contacts a surface of a workpiece W during use. Generally, an operator of the tool 100 may hold or grip the tool 100 by providing their hand around the handle 106 and place the nose 112 at a desired location for applying the staple, and depress the trigger 108 in order to activate the power unit 110 and cause a fastener or staple to be ejected at that desired location.

As generally known in the art, the magazine 102 is an elongated receptacle that extends away from the nose 112, towards a back end of the handle 106. In an embodiment, the magazine 102 may be positioned horizontally relative to the handle 106, such as shown in the Figures, for example. In another embodiment, the magazine 102 may be mounted at an acute angle relative to the vertical section 107, such that the magazine 102 is positioned at an obtuse angle relative to a workpiece W when the nose 112 is positioned and configured for applying the fastener thereto. Fasteners, nails, or staples may be arranged linearly in parallel within the magazine 102.

Figure 12:
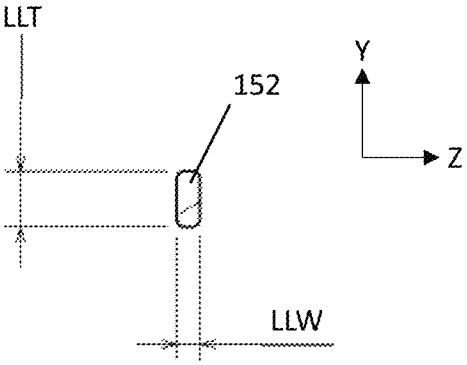
FIGS. 11-13 illustrate features of fasteners or staples that may be utilized in the tool in accordance with an embodiment of the disclosure.
Figure 13:
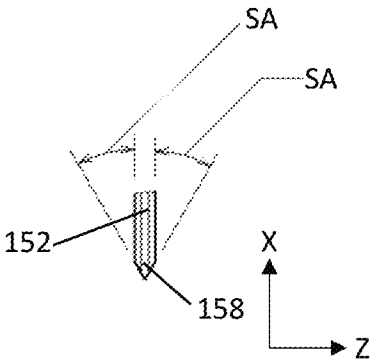
Figure 11:
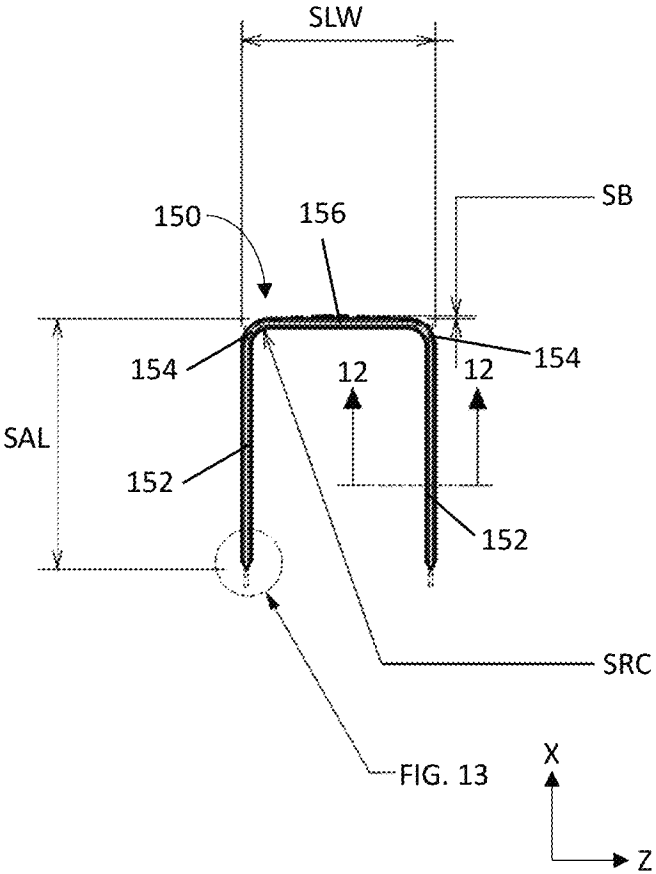

FIGS. 11-13 illustrate exemplary dimensions of staples that may be provided within the magazine 102 of tool 100, in accordance with an embodiment. As understood by one of ordinary skill in the art and shown in FIG. 11, for example, a staple 150 has two legs 152 extending vertically and parallel to one another. The legs 152 are connected to a top portion, or crown 156, of the staple 150 via curved edges 154 or curved corners. In some embodiments, such as shown in FIG. 13, the staples may include a pointed end or an angled end. Generally, the driver blade 120 is configured to apply force in a relatively downward direction to a lead fastener F of the magazine 102, which may be a staple 150, such that the legs 152 of the fastener may be driven into a workpiece. As explained in greater detail later, in accordance with embodiments herein, the driver blade 120 has a profiled driving edge that is configured to contact the curved edges 154 of either side of staple 150 to apply force thereto and to the legs 152, without contacting the crown 156.

Exemplary dimensions of such a staple 150 are shown in FIGS. 11-13. In an embodiment, the staples 150 inserted into magazine 102 to be driven by the herein disclosed driver blade 120 may have an axial length SAL (see FIG. 11) of approximately 25.34+/−0.30 mm. In an embodiment, the radius of curvature SRC of each of the corners or curved edges 154 of the staple are approximately 1.8+/−0.30 mm. In accordance with an embodiment, the staple has a lateral outer width SLW of approximately 19.60+/−0.20 mm. In another embodiment, the staple has a maximum lateral outer width SLW of approximately 19.75 mm. In an embodiment, the staple has a lateral inner width (i.e., the lateral width between an inner surface of each of its legs) (not shown) of approximately 18.647+/−0.20 mm. In accordance with an embodiment, the staple has a maximum bow SB on its curved edges 154 of approximately 0.30 mm. In an embodiment, such as noted in the cross-sectional view of FIG. 12, each of the staple legs 152 has a lateral width LLW of approximately 0.953+/−0.013 mm. In an embodiment, each of the staple legs 152 has a thickness LT of approximately 2.29+/−0.03 mm. In an embodiment, such as previously noted above, the legs 152 of the staples 150 may each have an insertion end 158 configured to go into a workpiece. In one embodiment, the insertion ends 158 are angled or pointed such that there is at least one pointed edge thereon. In one embodiment, at least one surface of the legs is angled towards the other surface. In another embodiment, such as illustrated in the detail of FIG. 13, either side of the insertion ends 158 of the legs 152 may be angled such that a central point is formed on the insertion end of the corresponding leg. In an embodiment, an angle SA on each side of the insertion end 158 may be approximately 30+/−5 degrees relative to the axial length of the staple 150 (or its legs 152).

In accordance with an embodiment, the fasteners or staples inserted into the magazine 102 may be collated; that is, as is known in the art and shown in FIGS. 14-17, multiple fasteners or staples 150 may be connected to each other in a linear group via a holding strip 160, forming collated fasteners (or collated staples). For example, a top portion of the fasteners (e.g., such as the crown 156 and curved corners or edges 154 of the staple 150) may be received in a frangible sleeve 162 that is part of the holding strip 160. The frangible sleeve 162 is designed such that a lead fastener may be separated from the group via force from driver blade 120 which drives the fastener into a workpiece W, thus breaking the frangible sleeve 162 of the lead fastener away from the rest of the holding strip 160. This frangible sleeve 162 further acts as insulation for a top (e.g., crown 156 and curved edges 154) of the staple 150.

Figure 14:
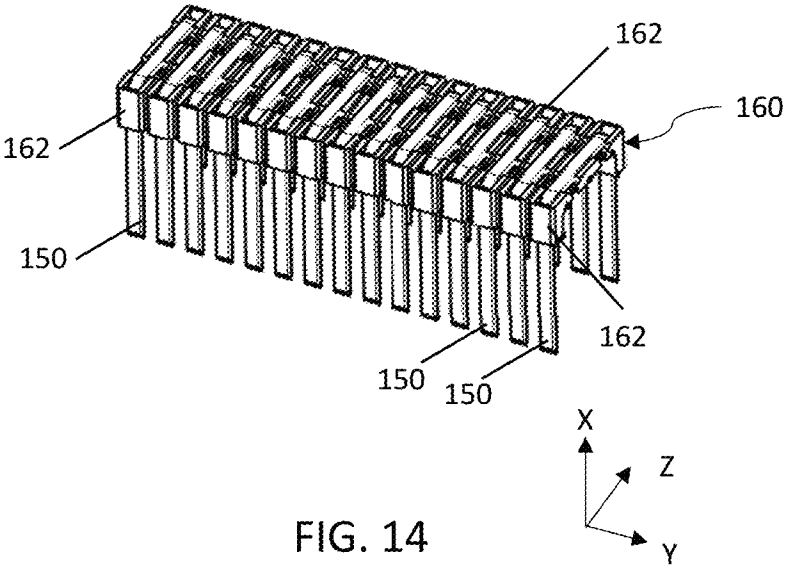
FIGS. 14-15 illustrate a set of collated fasteners that may be used in the tool in accordance with an embodiment of this disclosure.
Figure 15:
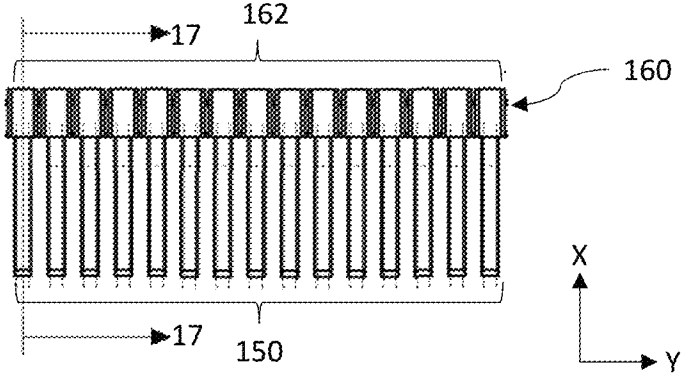
Figure 16:
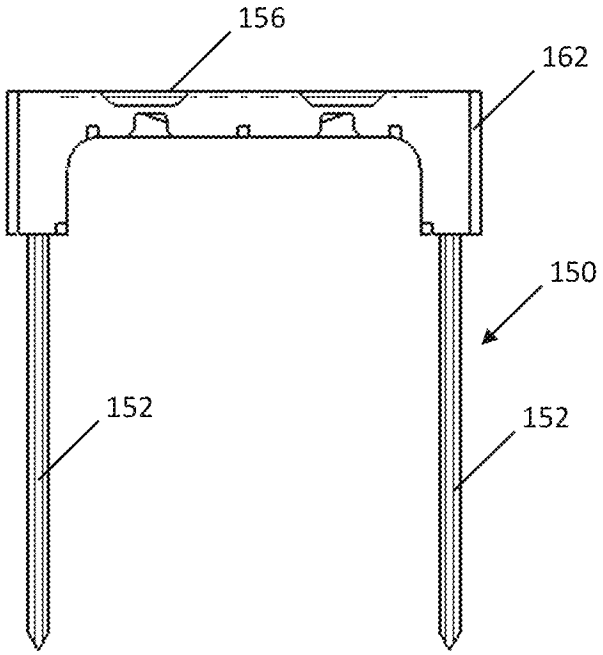
FIG. 16 illustrates a front view of a collated fastener from the set shown in FIGS. 14-15.
Figure 17:
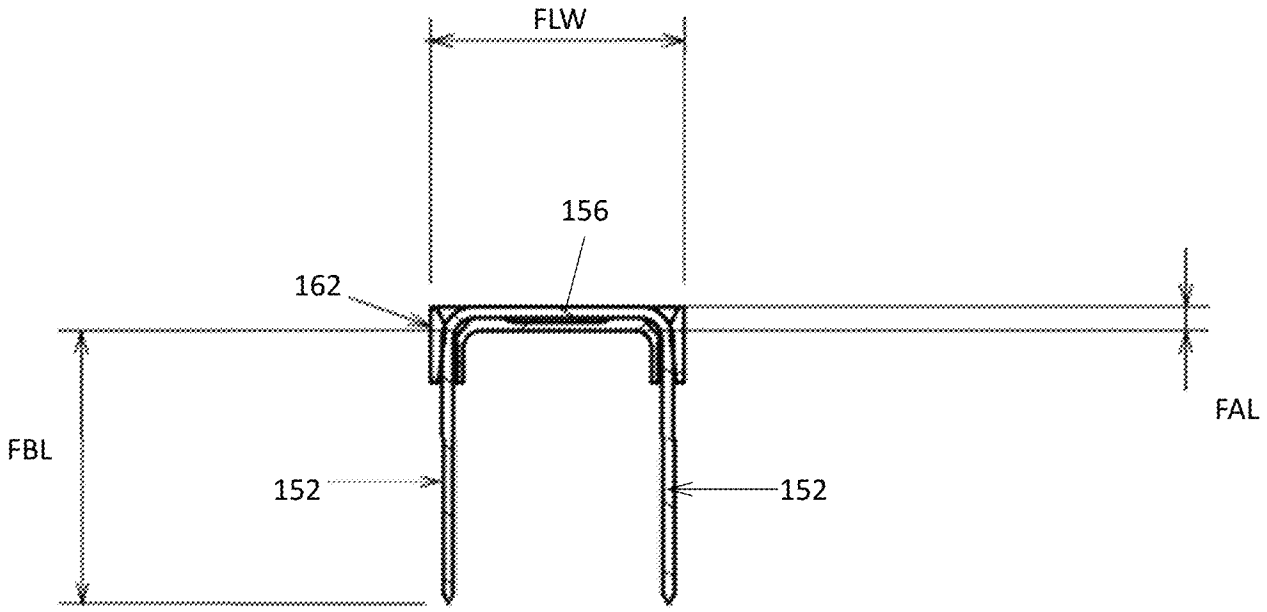
FIG. 17 is a cross sectional view of the collated fastener of FIG. 16.
Figure 18:
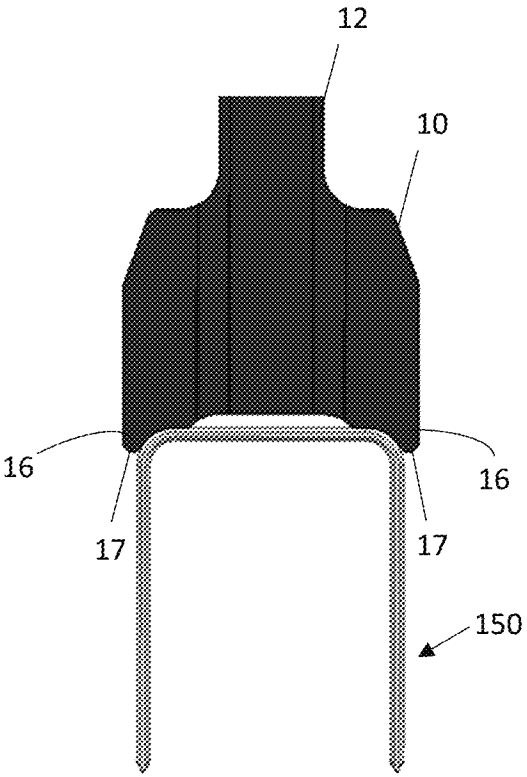
FIG. 18 illustrates the application of the staple driver having a scalloped blade profile, as applied to a staple, in accordance with an embodiment of the disclosure.

FIGS. 14-15 show examples of a series of staples 150 that are connected together via holding strip 160 with frangible sleeves 162 positioned around the crowns 156 and curved edges 154. The crowns 156 and curved edges 154 of the collated staples 150 are uncovered by the frangible sleeves 162, such as seen in FIG. 14 and FIG. 16. Accordingly, the curved edges 154 of each of the staple 150 are accessible to the driver blade 120 such that it may force the legs 152 of the lead staple 150 into a workpiece. Such features of collated staples and fasteners are generally understood by those of skill in the art and thus are not further noted here. In an embodiment, each fastener in the collated group as shown in FIGS. 14-15 may be a staple 150 with dimensions as described above with respect to FIGS. 11-13. In an embodiment, each frangible sleeve 162 has a lateral outer width FLW (see FIG. 17) of approximately 22.0+/−0.40 mm. In an embodiment, an axial length FAL of the frangible sleeve 162 between a top edge thereof (the top edge being positioned around the crown 156 and corner edges 154 of the staple 150) and a bottom edge thereof (the bottom edge being positioned below the crown 156 and between the legs 152 of the staple 150) is approximately 2.5+/−0.3 mm. In one embodiment, an axial length FBL between a bottom edge of the frangible sleeve 162 and a plane across the insertion ends 158 of the legs 152 is approximately 23.25+/−0.30 mm.

Referring back to FIGS. 4-9, as is understood by those of skill in the art, the magazine 102 may include a track 123 which is secured between the power unit 110 and the back end of the handle 106. The track is suitably shaped so as to receive the fasteners therein. In an embodiment, the track has a generally rectangular shape that defines a channel which is located between outer walls. In an exemplary embodiment, the fasteners are staples so the track has a width and depth to hold the fasteners and move the fasteners toward the nose 112. In one example, the track may be extruded from a suitable metal, such as aluminum. In other examples, the track can be otherwise formed, shaped or molded from other materials into the desired shape to hold the dispense the fasteners. Such other materials can include other metals, alloys, plastics, composites and the like.

Figure 34:
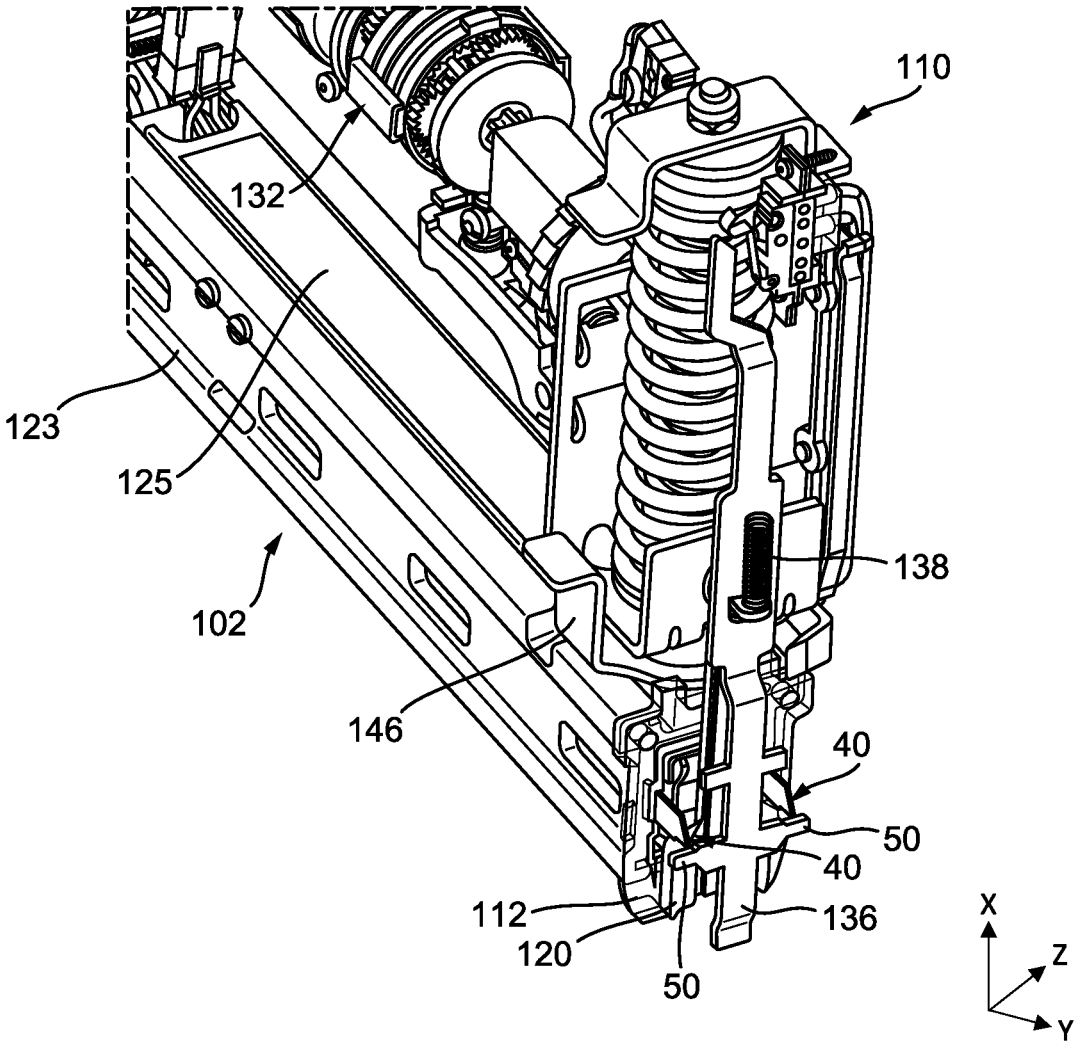
FIG. 34 is a perspective view of parts within the tool in accordance with an embodiment.

A runner 125 may be received into the track 123 (e.g., see FIG. 34), in accordance with an embodiment. The runner 125 may slide within the track 123 along the elongated (or longitudinal) direction of the track (i.e., the same direction as a longitudinal direction of the tool 100, e.g., along the Y-axis). The runner may have a cross-sectional profile that is similar to a cross-sectional profile of the track such that the runner is configured to slide along the track from a closed position (i.e., the runner being provided within the track, ready for operation to apply fasteners) to an open position (i.e., extending out of track, ready for loading of staples therein). In the closed position, the runner may be secured in position with a locking grip engaged to an end cap of the track. Such features are generally known in the art, as well as described in the incorporated '600 application noted later below, and thus not further described here.

As fasteners or staples are ejected from the nose 112, the group or plurality of fasteners within the magazine 102 are moved towards the nose 112, e.g., via an advancing mechanism provided in the magazine 102, which may include a spring (not shown). For example, collated fasteners may be loaded into the receptacle of the magazine 102 and fed towards a drive channel 114 adjacent the nose 112 by a spring-loaded pusher 116. The pusher 116 is configured to move in a feed direction (i.e., a direction towards the drive channel 114) to present and feed a lead fastener of the plurality of fasteners within the magazine 102 into drive channel 114. The pusher 116 may be positioned inside the track and may slide along the track in a space between the runner and the track, which is the space the fasteners may also occupy. In this position, the pusher 116 may contact the fasteners. The pusher 116 may be connected to the runner by a biasing member or spring (not shown). In an embodiment, the biasing member may be a coil spring that is connected to a portion of the runner and pusher 116. In another embodiment, the biasing member for spring-loading the pusher 116 may be a leaf spring connected thereto. The biasing member exerts a force on the pusher 116 to bias the pusher 116 toward a dispensing end of the track, i.e., the drive channel 114, which is adjacent to the nose 112. Accordingly, when released, the pusher 116 may exert a force on the fasteners to urge the collated fasteners to move along the track in the feed direction toward the dispensing end and drive channel 114 of the tool 100. In this manner, the pusher 116 pushes the fasteners toward the dispensing end so that a lead fastener in the group of fasteners may be positioned in the drive channel 114 and positioned for ejection via the power unit 110 and driver blade 120 at the nose 112 of the tool 100.

Figure 27:
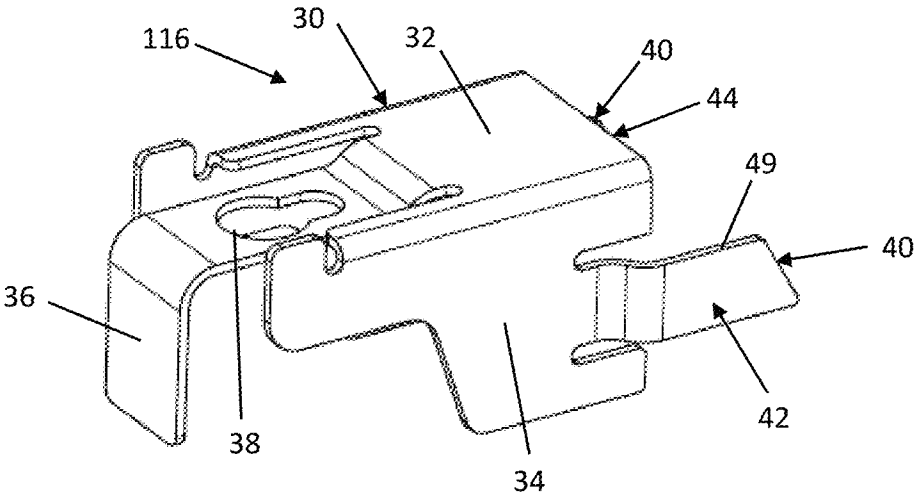
FIGS. 27-29 illustrate a perspective view, top view, and side view, respectively, of a pusher used in the tool, in accordance with an embodiment herein.
Figure 28:
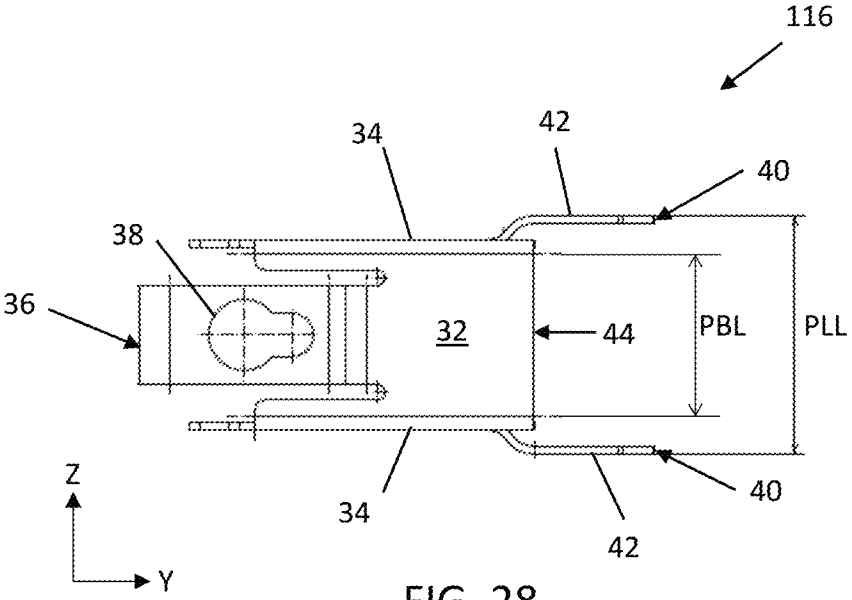
Figure 29:
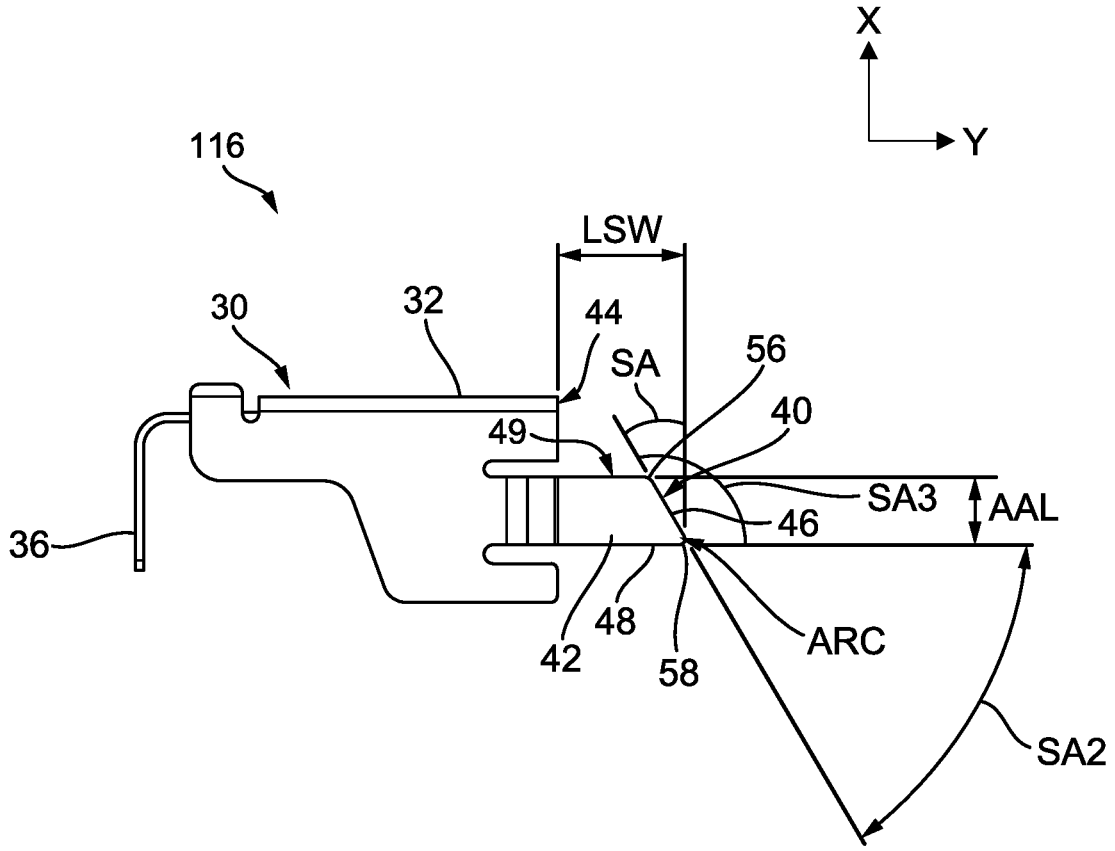

In one embodiment, such as shown and described with respect to FIGS. 27-29, the pusher 116 may include a body comprising at least one pusher lockout surface. The one or more pusher lockout surfaces may be provided on a respective arm that projects forwardly from the body and towards the drive channel 114. The pusher lockout surface(s) may be configured to cooperate and move relative to a contact trip mechanism, and, thereby, used in order to limit movement of the contact trip when the magazine 102 is empty or nearly empty of fasteners. Such features are described in greater detail later with respect to FIGS. 27-47.

Figure 6:
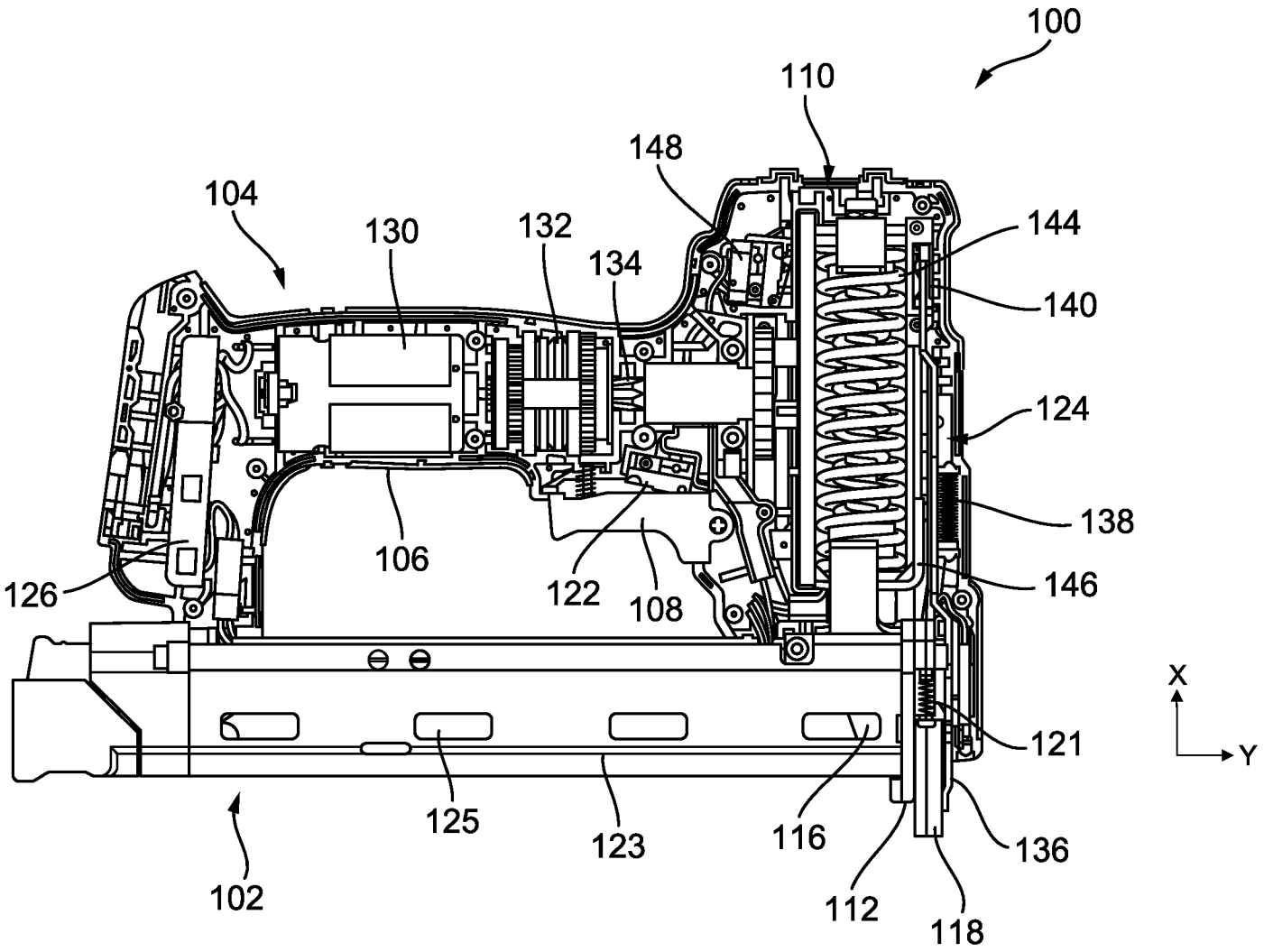
FIGS. 6 and 7 are cross-sectional views of the tool, taken along line 6-6 in FIG. 5, illustrating parts provided within a housing of the tool, in accordance with embodiments herein.

In an embodiment, such as shown in FIGS. 4, 5, and 6, a cable guide 118 may be provided on the nose 112 of the housing 104. As seen in FIG. 5, the cable guide 118 may include a cut-out portion 119 to accommodate a cable or a wire being secured to a workpiece. The cable guide 118 assists an operator in placement of tool 100 and fastener application, e.g., such that a driven fastener may be substantially centrally aligned around the cable. The cable guide 118 is configured for vertical movement via a spring 121 (shown in FIG. 6). That is, the cable guide 118 may be depressed such that it moves relative to and into the housing 104 when force is applied thereto. Generally, such a guide device is known in the art. For descriptive purposes and clarity only, the cable guide 118 has been removed from FIGS. 7-9.

In one embodiment, the back end 105 may have a removable and rechargeable energy storage device, which may include a battery pack 113. The battery pack 113 may configured to engage an end portion of the tool 100 and provide power to a motor 130 within the housing 104, such that the tool 100 may drive one or more fasteners which are fed from the magazine 102 into a workpiece W. The location of the battery pack 113 as shown in the Figures is not limiting and is illustrative only; indeed, the battery pack can be located anywhere on the tool 100. In addition, although the energy storage device is illustrated as being a battery pack, embodiments of this disclosure are not limited to battery packs being the energy storage device.

In an embodiment, the handle 106 extends between the front end 103 and the back end 105 of the housing 104. The trigger 108 may be provided in the form of a button on a bottom of, or below a portion of, the handle 106 for manual operation such that when an operator grips the handle 106, the trigger 108 may be engaged by a forefinger of the operator. The trigger 108 is mechanically coupled to the handle 106 and electrically coupled to at least an electric motor 130 and control module 126 (or controller) such that electric power may be selectively provided thereto. As shown in the exemplary cross-sectional view of FIG. 7, the trigger 108 may be pivotally mounted to the housing 104 by way of a pivot 128, such that application of force via the operator's forefinger pivots the trigger 108 relative to the handle 106. The trigger 108 may be associated with a trigger switch 122, a contact trip assembly 124, and control module 126. As described later below, the contact trip assembly 124 acts as a safety mechanism to prevent accidental activation of the tool 100. Generally, the trigger switch 122 is designed to activate a motor 130 (described below) within the housing 104 when the trigger 108 is pulled by the operator's forefinger and all other conditions for firing are met. That is, the trigger switch 122 may be provided in a normally open position and closed when the trigger 108 is pulled or depressed. Accordingly, when the trigger switch 122 is closed, driver blade 120 is in its home or rest position (i.e., microswitch 148 is closed), and the contact trip assembly 124 has also been enabled, the motor 130 may be initiated.

Figure 7:
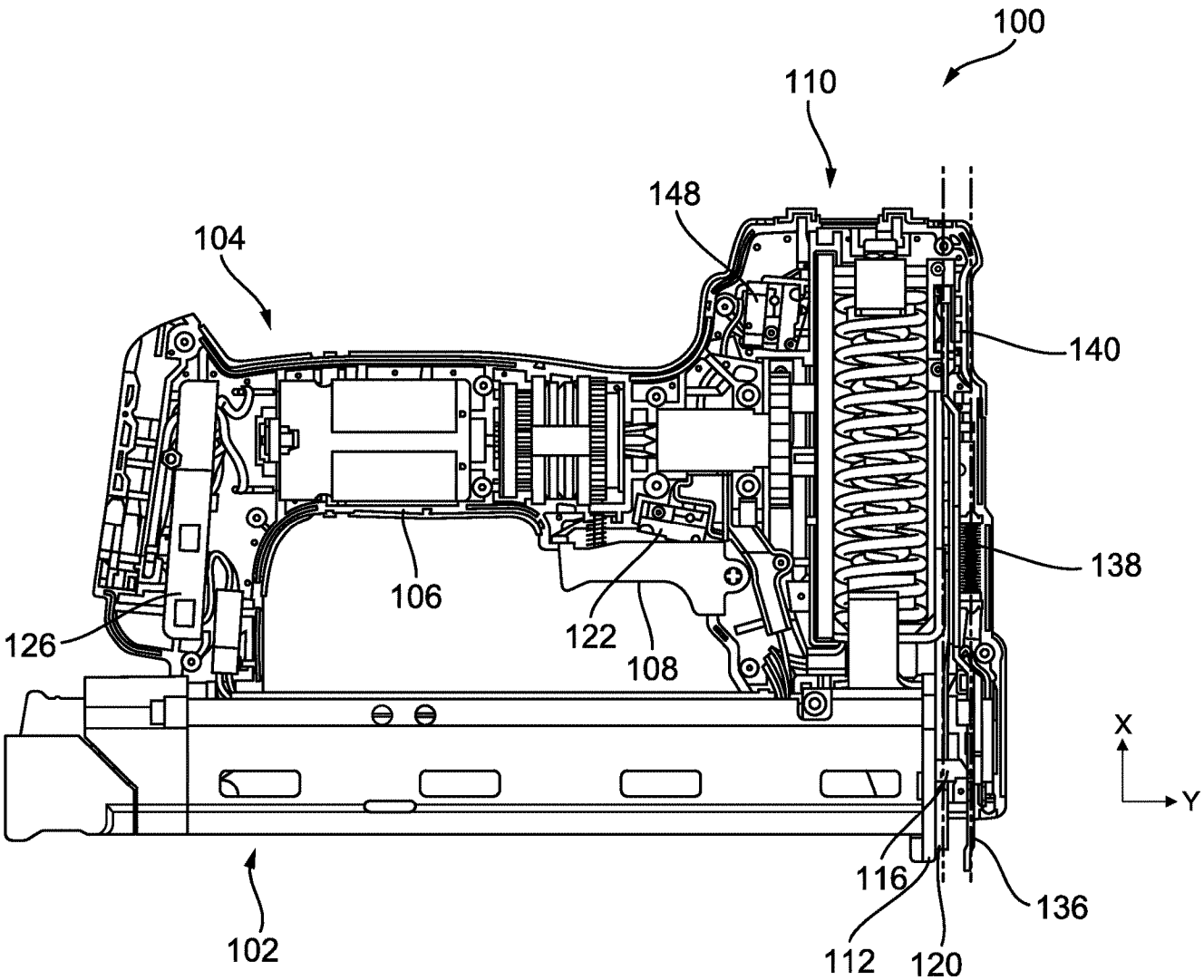

The motor 130 and a transmission unit 132 are part of a drive system that is configured to drive movement of the driver blade 120. The motor 130 and a transmission unit 132 may be disposed between the magazine 102 and the handle 106. In the exemplary illustrative embodiment, as seen in FIG. 7, the motor and transmission unit 132 may be provided within the handle 106. The motor 130 includes a rotatable output shaft that extends into the transmission unit 132. As understood by those of skill in the art, the transmission unit 132 may include a gear reduction mechanism (which may be a planetary gear reduction mechanism), which reduces the rotational speed of the output shaft of the motor 130 and causes rotation of a drive shaft 134 at a reduced rotational speed and increase torque applied to a crank arm. The gear reduction mechanism is rotatably connected to the motor 130 through the motor output shaft so that the rotation of the motor output shaft rotates the gear reduction mechanism. The gear reduction mechanism transmits a rotational force to the drive shaft 134. The drive shaft 134 is rotatably connected to a crank arm, which is configured to rotate along a circular path about the drive shaft 134.

As mentioned, the trigger 108 is also in communication with a control module 126. The control module 126 and circuitry may be provided at the back end 105 of the housing 104, for example, adjacent the location of the battery pack 113. The control module 126 may be provided in the form of a microprocessor and one or more circuit boards. The control module 126 also communicates with the motor 130. Upon receiving a signal from the trigger switch 122, a safety mechanism, switch 148 and/or the contact trip assembly 124 (described later below), the control module 126 may be connected to the battery 113. The control module 126 may signal the motor 130 to energize for a predetermined amount of time (e.g., by applying voltage to the motor 130), which causes its rotatable output shaft to rotate, thereby initiating a drive stroke. The electric motor 130 provides a power source to the tool 100 to operate the power unit 110 and thus the driver blade 120. As motor 130 turns, power is transmitted through the transmission unit 132 and the drive shaft 134, cycling the power unit 110 within the vertical section 107.

Figure 8:
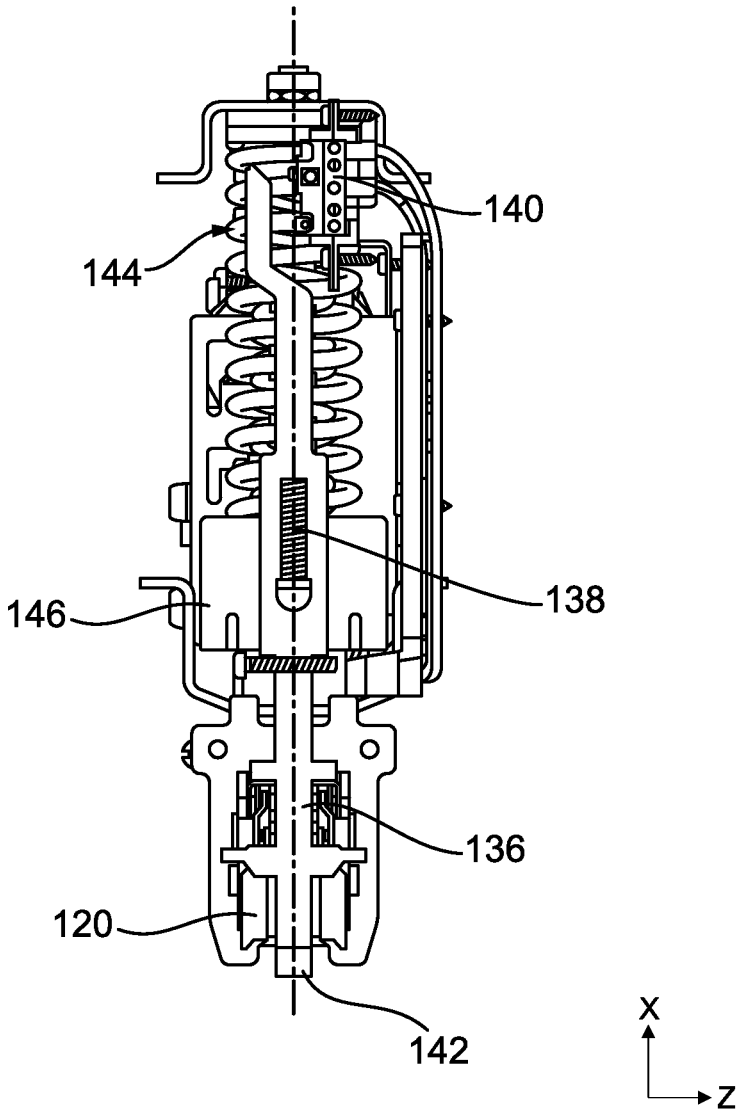
FIG. 8 is a front view of a power unit and driver of the tool of FIG. 4, with the housing removed for clarity purposes only.
Figure 9:
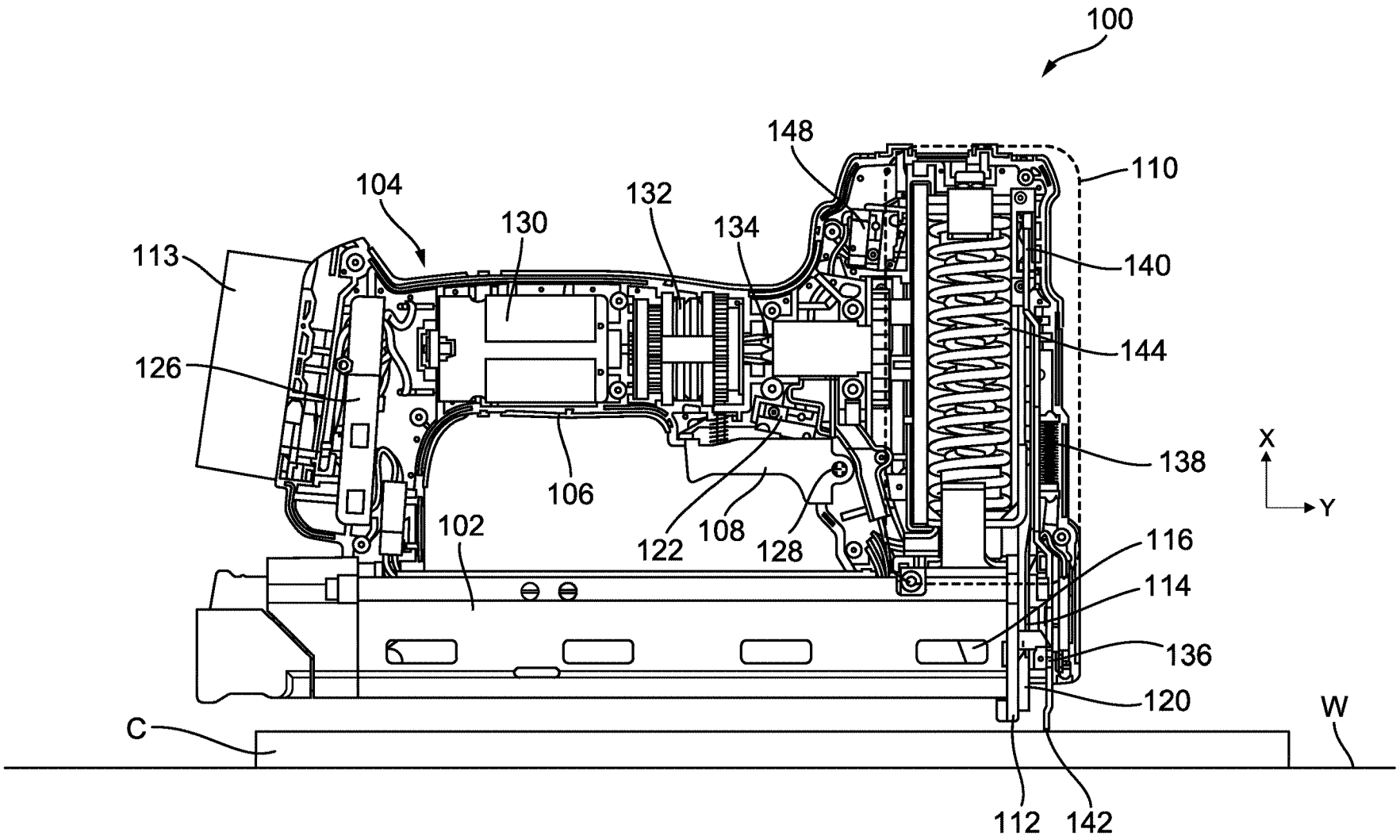
FIG. 9 is a cross-sectional view along line 6-6 of the tool showing an example of its use for applying a cable to a workpiece, in accordance with an embodiment herein.
Figure 10:
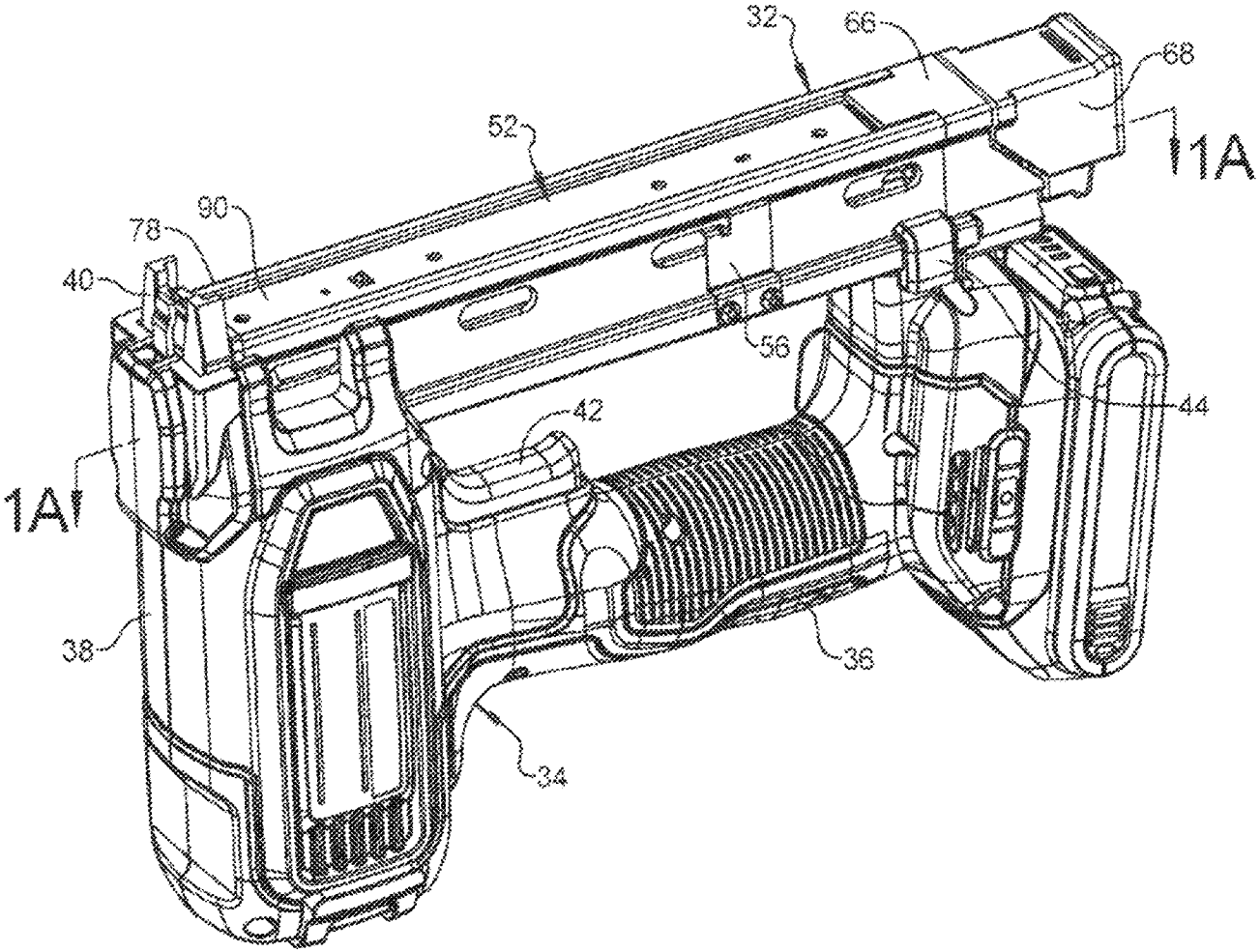
FIG. 10 illustrates an embodiment of a portable fastening driving tool having the staple driver according to an embodiment of the disclosure.

The power unit 110 is provided at front end 103 of the housing 104, within the vertical section 107. In an embodiment, a safety device in the form of a contact trip assembly 124 may be provided on the tool 100, such that, in order to propel the driver blade 120 and drive a fastener into the workpiece W, the safety device must first be deactivated. Other safety devices (e.g., mechanical and/or electrical, like switches) may also be provided in the tool 100. In the illustrative embodiment, the contact trip assembly 124 is provided as one safety device and in the nose 112 of the tool 100. In one embodiment, the nose 112 includes drive channel 114, a fastener driver blade 120 movable through a drive stroke to drive a fastener. Parts of the contact trip assembly 124 may be provided in the vertical section 107 of the housing 104, adjacent to the power unit 110 and driver blade 120. In an embodiment, the contact trip assembly 124 includes a contact trip 136 (or contact trip member) actuatable to initiate the drive stroke. The contact trip assembly 124 may be activated such that the driver blade 120 drives the lead fastener into a workpiece, upon pulling of the trigger 108. The contact trip 136 includes a body with a contact surface 142 and extends into the drive channel 114, and is configured for reciprocal movement relative to the housing 104, upon application of force to the contact surface 142 (i.e., when contacted with a workpiece and when a an operator pushes down on the tool 100 via handle) between a rest position and an enabled position that causes activation of the motor 130. In an embodiment, such as shown in FIGS. 30-34, guide arms 54 are provided on the body of the contact trip 136. As generally known in the art, guide arms 54 are designed to interface with internal ribs and/or features provided in housing 104 in order limit travel or movement of the contact trip 136 during operation of the tool 100. The contact trip 136 is positioned in front of the driver blade 120 in the housing 104 of tool 100. The contact trip 136 is configured for movement relative to the housing 104 parallel to the movement of the driver blade 120. Also provided in the drive channel 114, as shown in FIG. 7 and in greater detail in FIG. 8, are a contact trip spring 138 and a trip switch 140. The trip switch 140 is configured such that, depending on the position of the body of the contact trip 136, the trip switch 140 may be tripped or actuated (e.g., closed) to allow use of the tool 100 (when all conditions are met for driving or firing). The trip switch 140 may be provided in a normally open position and closed when the spring 138 is compressed by the contact trip 136. Accordingly, when the contact trip assembly 124 is in its normal position such that the contact trip 136 extends from the housing 104, i.e., its rest position, the motor 130 and power unit 110 may not be operated. In order to move the contact trip assembly 124 to its enabled position such that the motor 130 and power unit 110 may be operated, force may be applied to the contact trip 136 to depress it, moving the contact trip 136 such that it trips the trip switch 140, and may allow a drive sequence to start. As an operator applies force or bias on the tool 100, i.e., towards a workpiece W, the contact surface 142 engages the workpiece W and then actuates movement of the body of the contact trip 136 generally in a vertical direction into the drive channel 114. The body of the contact trip 136 compresses the contact trip spring 138, and closes the trip switch 140. Thus, the tool 100 is placed in a ready state, waiting for the trigger 108 to be pulled by the operator. That is, when the trip switch 140 is closed (and any other conditions are met for readying and then activating the tool), the motor 130 may be initiated after depression of trigger 108. Otherwise, if the contact trip assembly 124 has not be activated, then pulling of the trigger 108 will not actuate the motor 130.

In addition to the trigger switch 122 and trip switch 140, another switch 148 may be included in the housing 104 that is used for determining activation of the tool 100. Switch 148 is associated with the power unit 110 and is in communication with control module 126. The switch 148 is configured such that it may be positioned for power to be delivered to the power unit 110. Specifically, in an embodiment, switch 148 is configured, in a default or first position, to limit movement or activation of the power unit 110 in a rest position, and thus limit movement of the driver blade 120. When the switch 148 is moved to its second position, power to the motor 130 and power unit 110 may be limited. The switch 148 may be provided in a normally closed position and opened when the driver blade 120 is moved by a carriage/spring 144+bracket 146. In an embodiment, the tool 100 is placed in a ready state when both switch 148 and trip switch 140 are closed, waiting for the trigger 108 to be pulled by the operator. Once trigger 108 is pulled, trigger switch 122 is also moved to its closed position. As such, when all switches 122, 140, and 148 are closed, the tool 100 is in an active state wherein the motor 130, transmission 132, and power unit 110 are activated to drive a fastener. During driving of the driver blade 120, the switch 148 is opened. Opening of switch 148 may cause a signal to be sent to control module 126 such that a determination by the control module 126 is made to limit or stop the motor 130 and power unit 110.

As is generally known, one or more, or all, of switches 122, 140, and 148 may be microswitches.

In accordance with an embodiment, the power unit 110 of the tool 100 may be a mechanical spring engine. Such a spring engine may include a drive spring assembly 144 including a drive spring and driver mounting bracket 146, i.e., a mount located in the drive channel 114, and is configured to move through successive operating cycles, each of which includes a downward drive stroke and an upward return stroke. For the purpose of effecting the movement of the spring assembly 144 and bracket 146 through successive operative cycles of movement, the battery pack 113 may supply energy to the electric motor 130. As shown in FIG. 7, in accordance with an embodiment, a rear end of the drive spring assembly 144 may be anchored to the housing 104 with a suitable structure that holds the rear end of the spring assembly 144 and prevents movement of the rear end of the spring assembly. At rest, the drive spring is compressed. When the power unit 110 is activated, the drive spring decompresses and moves bracket 146 (downwardly within vertical section 107), which is provided on the other (forward) end of the drive spring assembly 114. The driver blade 120 is connected to the bracket 146, and thus the driver blade 120 may be reciprocally moved relative to the housing 104. That is, the driver blade 120 is forced to follow linear motion of the mechanical spring engine or power unit 110. The movement of the driver blade 120 may be referred to as linear along an axis (e.g., a longitudinal axis or a vertical axis X with respect to the vertical section 107 of the housing 104) within the drive channel to drive the lead fastener into a workpiece. Actuation of the driver blade 120 drives staples, which are sequentially fed from the magazine 102. During use, as the mechanical spring engine/power unit 110 is cycled via the activation of motor 130, transmission 132, and drive shaft 134, the drive spring 144 is compressed and then released. Accordingly, during the downstroke of the bracket 146, the driver blade 120 is propelled into the lead fastener, and thereby driving the fastener into the workpiece W.

Accordingly, an exemplary operation of the tool 100 may include an operator or user positioning the nose 112 (and optionally a cable guide 118) over a cable C to be fastened to a workpiece W. As the operator places bias on the tool 100 towards the workpiece W, movement of the contact trip 136 (and optionally cable 118) is actuated. Accordingly, the contact trip spring 138 is compressed and the trip switch 140 is closed, placing the tool 100 in an active state, waiting for the trigger 108 to be pulled or depressed. When the trigger 108 is pulled by the operator (thereby pivoting the trigger 108 about pivot 128), the trigger switch 122 is closed, initiating motor 130. As motor 130 turns, power is transmitted through the transmission unit 132, and drive shaft 140, cycling the mechanical spring engine SA/power unit 110. As the power unit is cycled, the drive spring assembly 114 is compressed and then released, propelling the driver blade 120 into the lead fastener of the magazine 102 that is positioned in the drive channel 114. Accordingly, the driver blade 120 drives the lead fastener into the workpiece W, securing the cable C. The motor 130 may then continue to turn, returning the driver blade 120 to its position until a home position switch signals to the microprocessor/control module 126 that the drive cycle has concluded. In some cases, one or more of the switches may signal the control module 126 to stop operation of the motor 130 and power unit 110. At this point, the control module 126 sends a braking signal to the motor 130 and waits for the operator to release and re-engage the trigger 108 prior to another cycle commencing. The spring loaded pusher 116 is designed to feed fasteners towards the drive channel 114 in the nose 112. This sequence of events may be repeated for each fastener fired from the tool 100.

In accordance with one embodiment, the fastening tool can be a cordless stapler as illustrated in FIG. 7 based on U.S. patent application Ser. No. 15/884,600 filed Jan. 13, 2018 and entitled Magazine with Lockback Pusher for Use with Stapling Device, which is hereby incorporated by reference in its entirety.

Referring now to FIGS. 18-21, one embodiment of the driver blade 120 that may be utilized in the tool 100 is illustrated. In an embodiment, the driver blade profile is in the form of a scalloped member that provides contact points above the legs of the staple and avoids contact of the driver blade with the crown of the staple. For example, as represented by the illustration in FIG. 11 (and described in detail below), a scalloped blade profile on a driving head 10 of the driver blade 120 ensures that the mid-section/crown 156 of a staple 150 or fastener is not in contact with the driver blade 120 when the driver blade 120 contacts the curved edges 154 of the lead staple 150 or fastener as presented by the magazine 102 into the drive channel 114. A first guide geometry and a second guide geometry on the driving contact surfaces and driving projections of the driver blade 120 are designed to position at least one of the blade 120 and the staple 150 with respect to each other. As a result, the staple and/or the blade 120 can be positioned correctly with respect to the other. Further, the driver blade 120, when actuated by the fastening tool, may securely apply a force to a predetermined area of the staple/fastener, such as at the corners and edges of the staple, to prevent buckling of the staple legs when the staple is driven. In operation, the driver blade 120 positions the driving force in line with the staple legs, rather than the center of the staple crown, which causes the observed buckling. As a result, the driver blade geometry of this disclosure prevents or substantially prevents the staple from buckling, such as shown in FIGS. 1 and 2 as a result of the prior art that utilizes flat profile driver blades.

Figure 19:
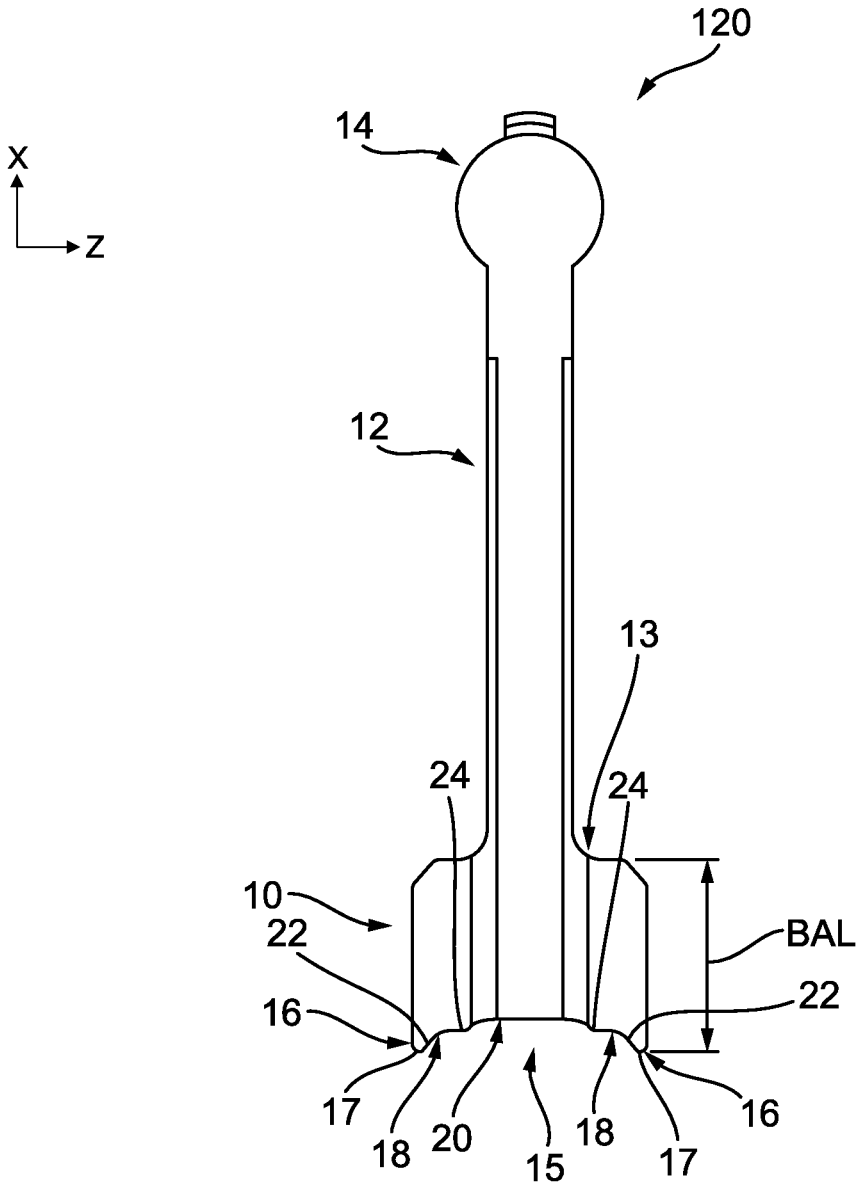
FIG. 19 illustrates a driver blade for use in the tool having a scalloped blade profile in accordance with an embodiment of the disclosure.

FIG. 19 shows a front view of the driver blade 120 in accordance with an embodiment herein. The driver blade 120 is provided in the housing 104 and configured for movement within the drive channel 114 to drive a lead fastener F (e.g., staple 150) into a workpiece. Generally, as is known in the art, the driver blade 120 is constrained by the housing 104 for linear movement within the drive channel 114. In an embodiment, the driver blade moves axially along an X-axis within the drive channel 114 in vertical section 107 at the front end 103 of the tool 100. As shown in FIG. 19, the driver blade 120 includes a body 12 extending in a longitudinal or axial direction, with a drive head 10 at one end thereof (e.g., a lower end) and a mounting end 14 at the other (e.g., an upper end). The mounting end 14 is connected to a portion of the power unit 110 such that the driver blade 120 may be reciprocated (with constraints) within the drive channel 114. In the illustrated exemplary embodiment, the mounted end 14 is shown with a generally circular portion that is designed for securement to driver mounting bracket 146. However, the illustrated shape of the mounted end 14 is exemplary only and not at all intended to be limiting. The drive head 10 has a top edge 13 on its upper end and a driving edge 15 along the bottom of its lower end. The driving edge 15 designed to contact and drive a lead fastener dispensed into the drive channel 114 from magazine 102 when the drive system (e.g., motor 130, power unit 110) is activated to dispense or fire a fastener.

Figure 20:
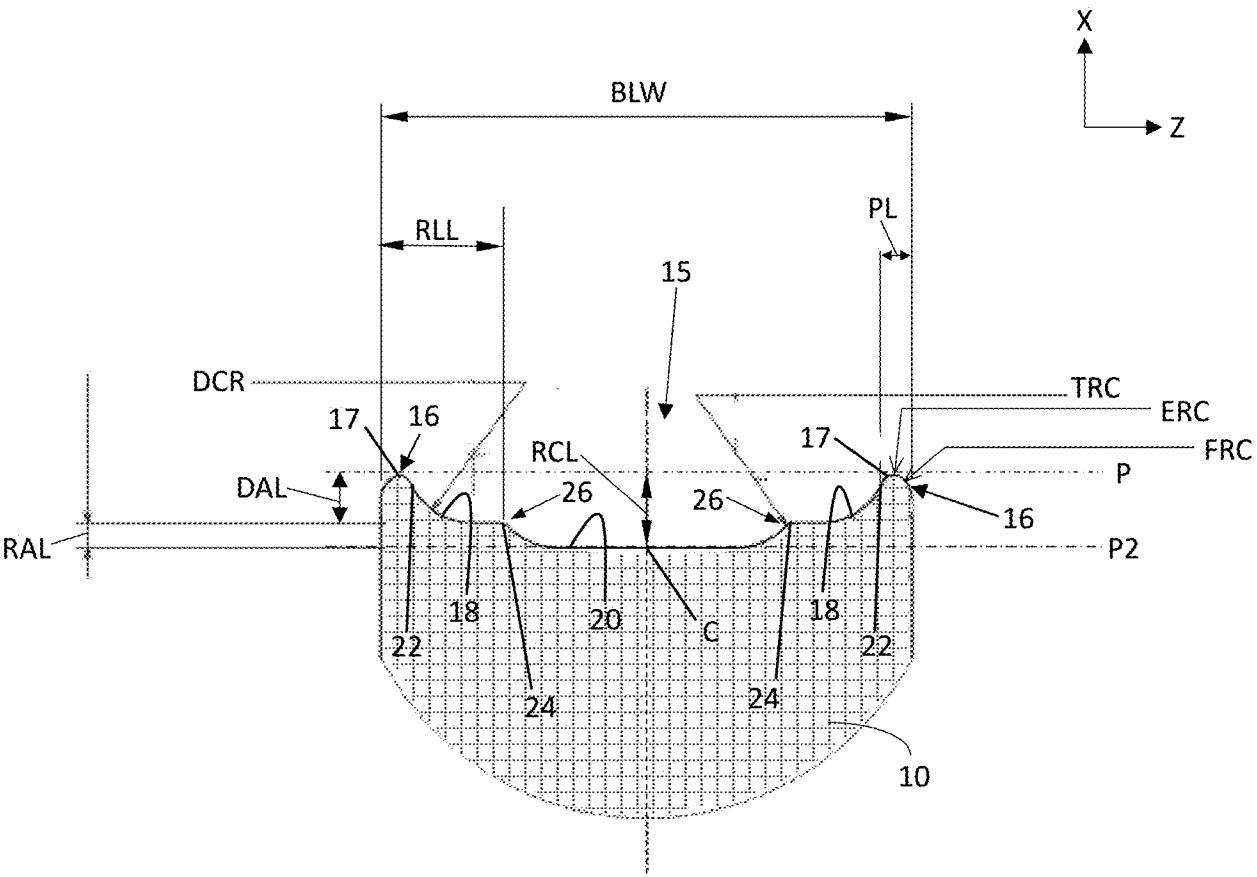
FIG. 20 is a detailed view of a driving edge of the driver blade of FIG. 19, showing the geometry of the driving edge.

As shown in FIG. 19 and in greater detail in FIG. 20, in accordance with an embodiment, the driving edge 15 may include a pair of driving projections 16 each configured for contact with curved edges (e.g., edges 154 of staple 150) of either side of a lead fastener above its legs. The driving edge 15 further includes a pair of driving contact surfaces 18, wherein at least a portion of each of the driving contact surfaces 18 has a curvature. In accordance with one embodiment, each of the driving projections 16 may include a driving contact surface 18, with a curvature, designed to contact a predetermined area of the fastener/staple. In an embodiment, the pair of driving contact surfaces 18 are provided on the pair of driving projections 16. The driving contact surfaces 18 are designed to contact the curved edges of the lead fastener when the driver blade 120 is deployed to fire a fastener/staple, in accordance with an embodiment. The driving projections 16 each have bottom edges 17 (see FIG. 18), which may be curved, and which are positioned outwardly relative to the curved edges of the driven fastener/staple. Further, the driving edge 15 has a relief portion 20 provided between the pair of driving projections 16. The relief portion 20 is recessed relative to both the driving contact surfaces 18, in accordance with an embodiment. In one embodiment, the relief portion 20 may be provided between the pair of driving projections 16 and in a center C of the driving edge 15. The relief portion 20 is effectively recessed relative to both of the driving contact surfaces 18 and ends or edges 17 of the pair of driving projections 16, as described in greater detail below.

As described previously, the first and second guide geometries of the driver blade 120 as disclosed herein produce a scalloped blade profile which results in the driving edge 15 having a non-contact surface length and a contact surface length (in at least the lateral (Z-axis) direction). The relief portion 20 results in non-contact with the lead fastener F, and thus the non-contact surface length of the edge 15, while the driving contact surfaces 18 of the driving projections 16 result in contact with the lead fastener F, and thus the contact surface length of the edge 15. Combined lateral lengths of the driving contact surfaces 18 provide the contact surface length of the driving edge 15. At least a lateral length of the relief portion provides the non-contact surface length of the driving edge 15. In an embodiment, the driving edge 15 has a ratio of non-contact surface length to contact surface length in a range of approximately 1.1 to approximately 1.8. In an embodiment, the driving edge 15 has a ratio of non-contact surface length to contact surface length in a range of approximately 1.3 to approximately 1.6. In accordance with one embodiment, the driving edge 15 comprises a ratio of non-contact surface length to contact surface length of approximately 1.6. In accordance with another embodiment, the driving edge 15 comprises a ratio of non-contact surface length to contact surface length of approximately 1.3.

In an embodiment, a portion and/or a curve of the bottom edge 17 of each driving projection 16 is configured to be positioned outside of outer surfaces of the legs of a fastener when the driving edge 15 is in contact therewith. In one embodiment, at least a portion of the bottom edges 17 (e.g., bottom curves) are not in contact with a surface of the fastener. Accordingly, a portion of the bottom edges 17 may be part of the non-contact length of the driving edge 15 of driver blade 120, in accordance with embodiments.

In one embodiment, the contact surface length is determined based on a lateral length of the driving contact surfaces 18, and the non-contact surface length is determined based on a lateral length of the relief portion 20 plus the lateral lengths of the bottom edges 17 of projections 16.

In one embodiment, the relief portion 20 is centered in a lateral direction (e.g., along Z-axis) relative to the pair of driving projections 16 of the driver blade 120. In an embodiment, a center C (see FIG. 20) of the relief portion 20 is provided at an axial length RCL of approximately 2.9+/−0.4 mm from a plane P positioned across bottom edges 17 of the pair of driving projections 16.

In accordance with an embodiment, the driver blade 120 has a lateral outer width BLW of approximately 21.70+/−0.20 mm. In an embodiment, the driver head 10 of the driver blade 120 has an axial length BAL (see FIG. 19), between the top edge 13 and bottom driving edge 15, of approximately 18.00+/−0.20 mm.

Also, in a lateral direction (e.g., Z-axis) of the driver blade 120, when the driver blade is provided in the housing 104 (or viewed as shown in FIG. 19), a curvature of each of the driving contact surfaces 18 has a lower end 22 further away from the relief portion 20 and a higher end 24 closest to the relief portion 20. Such features of the lower end 22 and higher end 24 may be better viewed in the detail of FIG. 20 (where the driving edge 15 is shown upside-down with respect to its mounting and in-use position). In an embodiment, a radius of curvature DCR of each of the driving contact surfaces 18 is approximately 2.5 mm to approximately 3.1 mm. In another embodiment, a radius of curvature DCR of each of the driving contact surfaces 18 is approximately 2.70 mm to approximately 2.90 mm. In accordance with one embodiment, the radius of curvature DCR of the driving contact surfaces 18 is approximately 2.80 mm. In an embodiment, an axial length DAL between the higher end 24 of the curvature of the driving contact surfaces 18 to a plane positioned across bottom edges 17 of the pair of driving projections 16 is approximately 1.9+/−0.2 mm. In an embodiment, an axial length RAL between the higher end 24 of the curvature of the driving contact surfaces 18 to a plane P2 positioned across a center C of the relief portion 20 is approximately 1.0+/−0.2 mm.

In an embodiment, each driving projection 16 has a lateral dimension (or lateral width) PL of approximately 1.0 mm to approximately 1.4 mm. In accordance with one embodiment, each driving projection 16 has a lateral dimension PL of approximately 1.2 mm. In one embodiment, the bottom edge 17 of each driving projection 16 has a radius of curvature ERC of approximately 0.30 mm to approximately 0.70 mm. In accordance with one embodiment, each driving projection 16 has a curve on a bottom edge 17 comprising a radius of curvature ERC of approximately 0.50 mm. In one embodiment, each driving projection 16 has a radius of curvature FRC between the bottom edge 17 to an outer lateral side of the driver head 10 of approximately 1.00+/−0.20 mm.

In an embodiment, a lateral dimension (or lateral width) RLL between the higher end 24 of the curvature of the driving contact surfaces 18 to an outer edge of the driving projection 16 is approximately 5.2 mm to approximately 5.6 mm. In accordance with one embodiment, a lateral dimension RLL between the higher end 24 of the curvature of the driving contact surfaces 18 to an outer edge of the driving projection 16 is approximately 5.4 mm.

In accordance with some embodiments herein, transition surfaces 26 may be provided on the driving edge 15 of the driver blade between the higher ends 24 of the driving contact surfaces 18 and the relief portion 20. As shown in the exemplary illustrated embodiment of FIG. 20, the transition surfaces 26 may be curved. In accordance with an embodiment, each of the transition surfaces 26 comprises a radius of curvature TRC of approximately 0.3 mm to approximately 0.7 mm. In accordance with one embodiment, each of the transition surfaces 26 comprises a radius of curvature TRC of approximately 0.5 mm.

In accordance with one embodiment, an axial length between the transition surfaces 26 of the driving edge 15 to plane P2 positioned across a center of the relief portion is approximately 1.0+/−0.2 mm.

Figure 21:
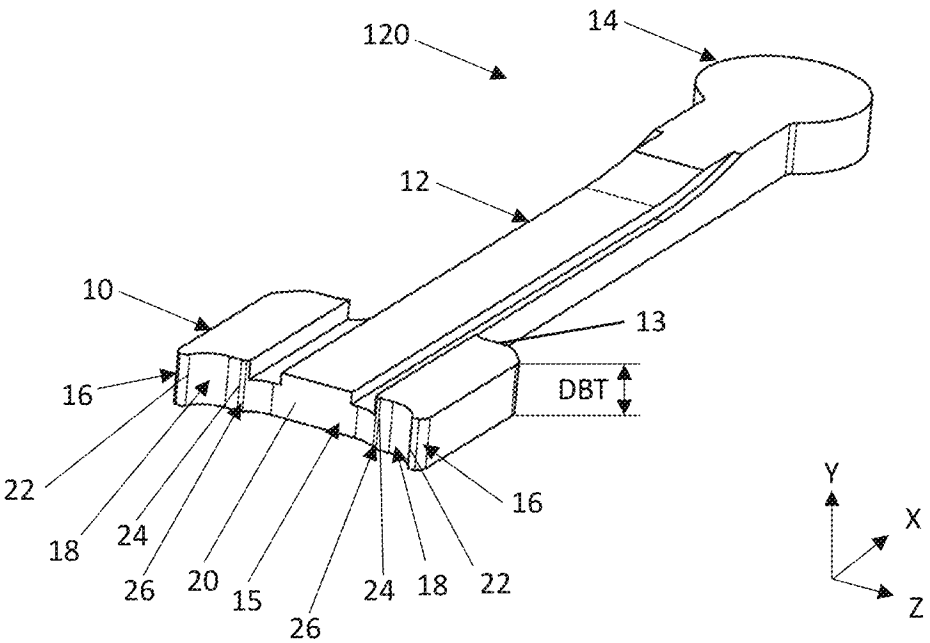
FIG. 21 is a bottom perspective view of the driver blade of FIG. 19.

The drive head 10 of the driver blade 120 may have a thickness DBT, such as shown in FIG. 21. In an embodiment, the drive head 10, body 12, and mounting end 14 each have the same thickness, DBT. In another embodiment, the thicknesses of drive head 12, body 12, and/or mounting end 14 vary.

Also, in an embodiment, one or more guide tracks (e.g., see FIG. 21) may be provided in the body 12 and/or drive head 10 of the driver blade 120 to guide and/or assist in movement of the driver blade 120.

Figure 25:
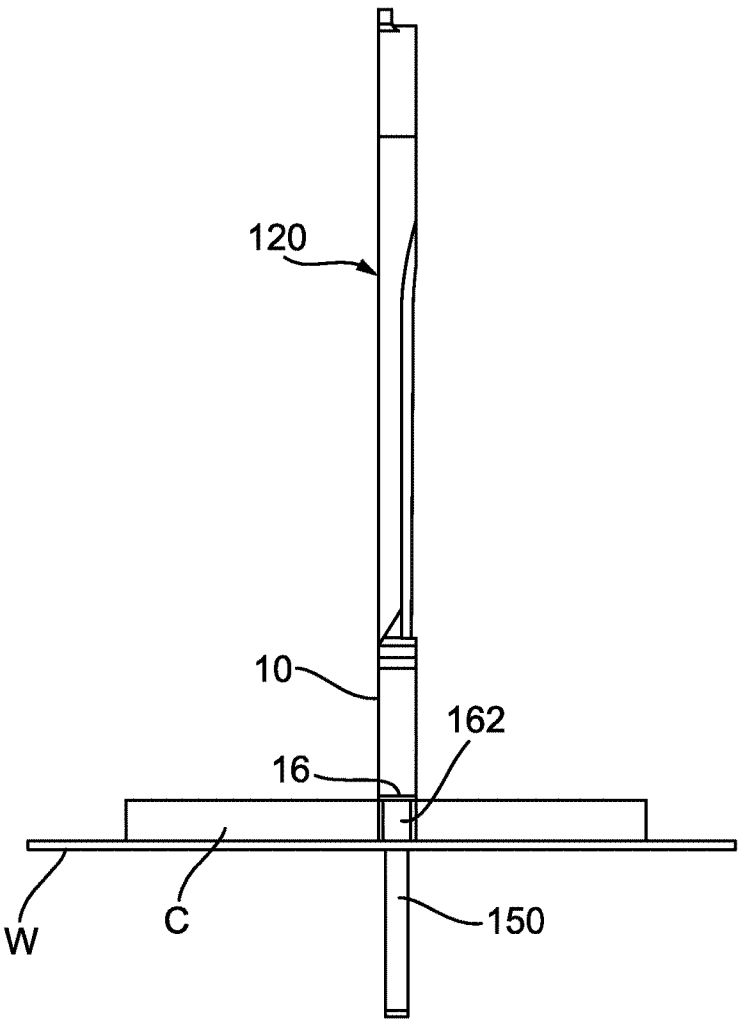
FIGS. 24-25 illustrate examples of the driver blade being used to drive a collated fastener around a cable and into a workpiece.
Figure 26:
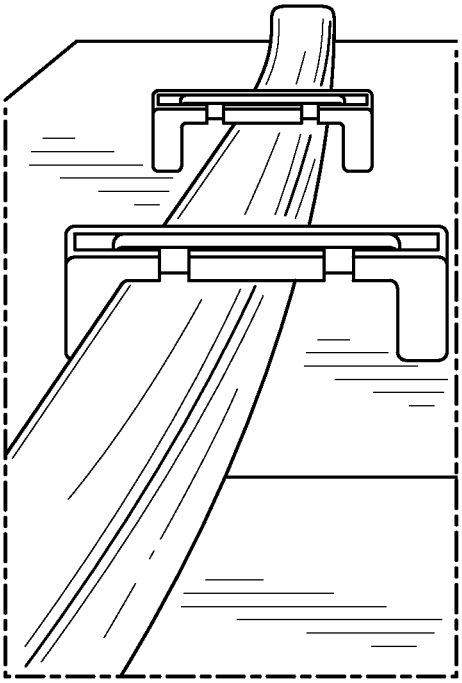
FIG. 26 illustrate examples of fasteners applied to a workpiece using the disclosed driver blade of FIG. 19 in the tool.

FIGS. 22-25 illustrate application of the scalloped driving edge 15 of the disclosed driver blade 120 to fasteners such as staples 150 and staples with insulation/frangible sleeves 162 when applying such a fastener to a workpiece W to secure a cable C. FIG. 26 illustrates an example of applied fasteners positioned in a workpiece W using the driver blade 120 in a tool 100 as disclosed herein.

Figure 23:
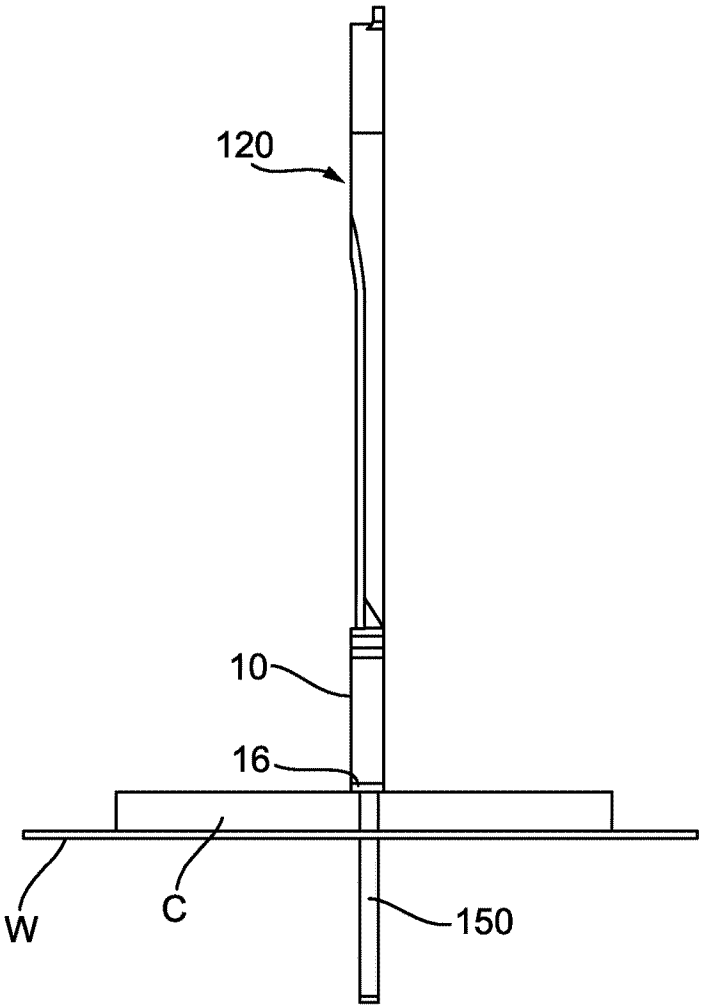
FIGS. 22-23 illustrate examples of the driver blade being used to drive a fastener or staple around a cable and into a workpiece.
Figure 22:
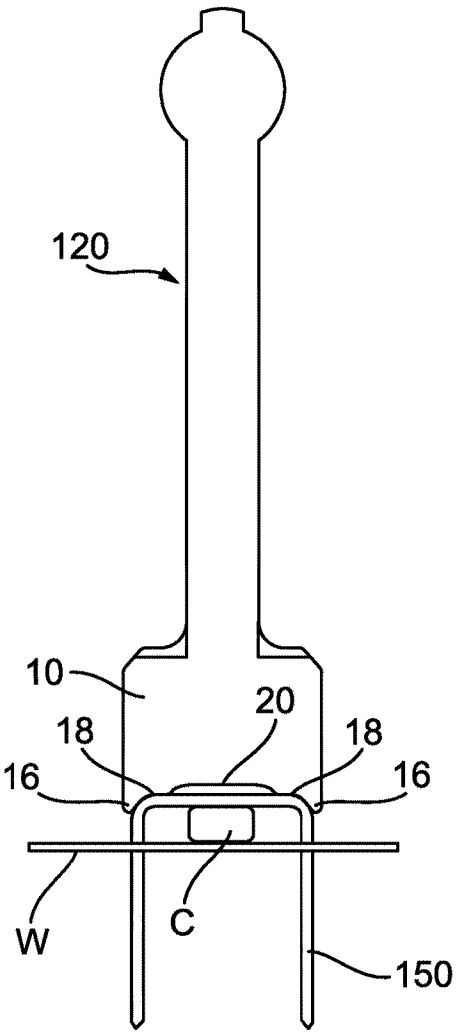
Figure 24:
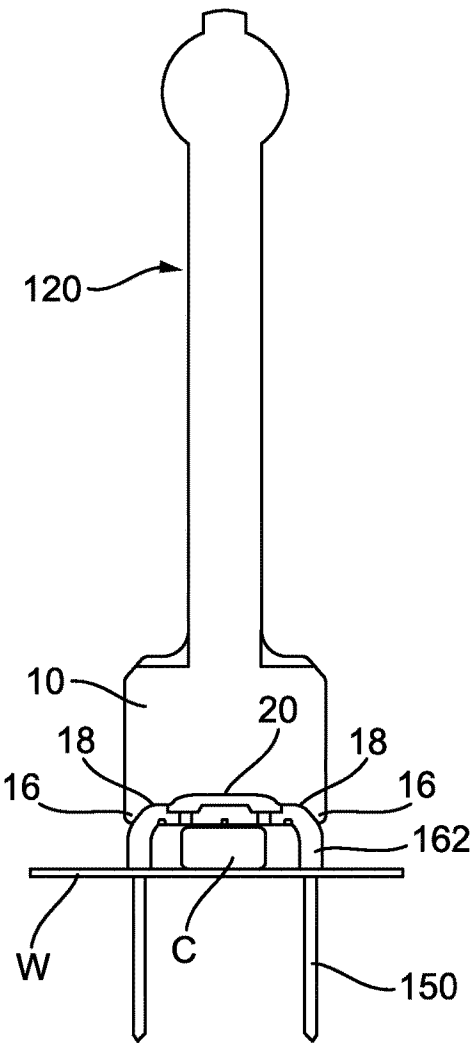

More specifically, as shown in as shown in FIGS. 22-23, the pair of driving projections 16 contact the curved edges 154 of either side of the lead fastener/staple 150 above its legs 152 via driving contact surfaces 18 when contact is made between the driver blade 120 and the staple 150. Similarly, because the frangible sleeve 162 or insulation provided on the collated fastener does not cover the crown 156 and curved edges 154 of the staple, the driving projections 16 are also configured to contact the curved edges 152 on either side of the lead fastener when the driver blade 120 is activated and contact is made therebetween, as shown in FIGS. 24-25.

Additionally, the relief portion 20 provided between the pair of driving projections 16 is recessed relative to both the driving contact surfaces 18 of the pair of driving projections 16 as well as the staple 150/fastener. FIGS. 22-25 further show that, when contact is made between the driver blade 120 and the lead fastener, whether a staple 150 or a collated fastener/staple like a staple 150 with frangible sleeve 162, the driving edge 15 of the driver blade 120 is spaced from the crown 156 such that there is a gap between the bottom of the driving edge 15 and the top of the crown 156 of the staple 150. That is, the recessed relief portion 20 provides a gap between at least the driving edge 15 and the crown 156 of the staple 150/fastener when contact is made between the driver blade 120 and the staple 150/fastener. In accordance with one embodiment, this gap may be substantially equal or equal to the axial length RAL between the higher end 24 of the curvature of the driving contact surfaces 18 to plane P2. In another embodiment, the gap may be substantially equal or equal to an axial length between the transition surfaces 26 of the driving edge 15 to plane P2. In some embodiments, the gap and/or axial lengths between the higher end 24 and the plane P2 and between the transition surfaces 26 and the plane P2 may be substantially equal or equal to each other. In an embodiment, the gap between the bottom of the driving edge 15 and the top of the crown 156 is approximately 1.0+/−0.2 mm.

Figure 3C:
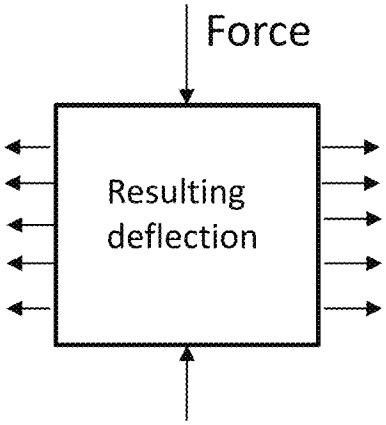
FIG. 3C PRIOR ART
FIGS. 3A-3C illustrate an existing driver blade typically utilized in a stapler.
Figure 3B:
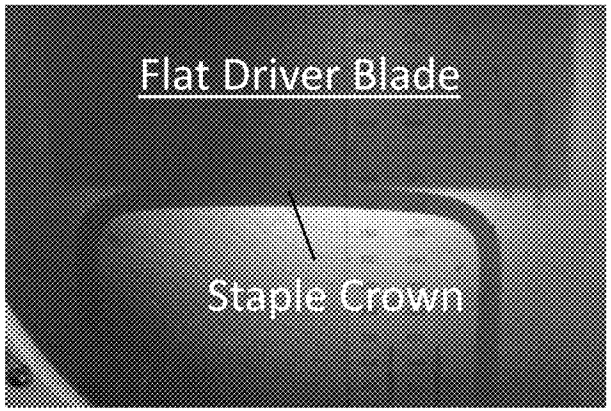
FIG. 3B PRIOR ART
Figure 3A:
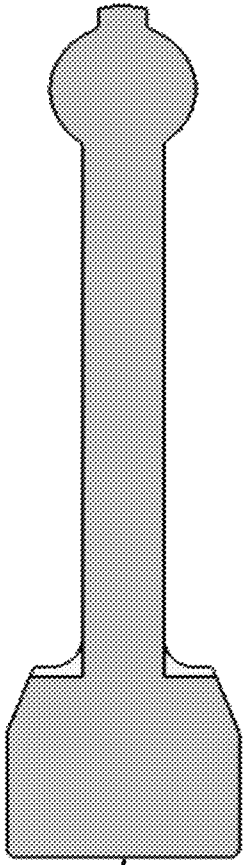
FIG. 3A PRIOR ART

As a result of the geometry of the driving edge 15 of the driver blade 120, then, one can see in FIG. 26 that buckling and/or bending of the legs 152 (such as shown and compared to fasteners as shown in FIGS. 1-2 which are driven using a flat surfaced driving blade) is prevented and/or substantially prevented. Even with fasteners (e.g., staples) that have pointed ends, the force inflicted onto each fastener by standard, flat driver blades like that of FIG. 3A during firing of the tool tends to cause buckling to one or more legs of the fastener during initial penetration into the workpiece. Accordingly, it is a first contact and impact of the fastener legs with the workpiece that tends to cause one or more legs of the fastener to buckle. In this case, the disclosed scalloped blade geometry of the edge 15 of the driver blade 120 prevents the legs from buckling during application or firing of the tool. This is because the disclosed geometry positions the driving force in line with the legs of the fastener, rather than on or at a center of the staple crown, which causes the observed buckling in the prior art applications. Because of the contact surface length of the driving edge 15 in the noted predetermined area (i.e., the curved edges of the fastener being driven), the force from the driver blade 120 is transmitted to the legs of the fastener such that the legs will penetrate and transmit force through and into the workpiece, thereby securely driving both legs into the workpiece.

In some very limited cases, if a cable C is of a larger diameter and/or made of stronger materials such that the driving force on the fastener/staple causes a crown of the staple to slightly bow, at least a portion of the crown may go up into the gap or relief portion of the driver blade 120. This is more likely to happen in off-spec (no name brand) staples that are used with the tool 100, for example. However, even in such a case, the driving contact surfaces 18 are still configured to apply force to the predetermined area, and the relief portion 20 is recessed such that there is a gap between the crown of the fastener and its inner surface or center.

In addition to improving the performance of the tool 100 via the driver blade 120, a lockout assembly is disposed within the tool 100, in accordance with an embodiment herein. Such a lockout assembly provides a user or an operator of the tool 100 an effective way to ensure that the tool does not fire if there are no fasteners and/or a very limited number of fasteners remaining in the magazine 102. In an embodiment, a mechanical mechanism may be used to determine activation of the lockout assembly. In one embodiment, described below, the mechanism is provided on the pusher 116.

FIGS. 27-29 illustrate an exemplary embodiment of the aforementioned spring-loaded pusher 116 being used as the advancing mechanism provided in the magazine 102 of the tool 100 in accordance with an embodiment herein. The pusher 116 is configured to move in a feed direction to present a lead fastener F (e.g., staple 150) of the plurality of fasteners within the magazine 102 into drive channel 114. As noted previously, the pusher 116 may be positioned inside a track of the magazine and may slide along the track in a space between a runner and the track, which is the space the fasteners may also occupy. In this position, the pusher 116 may contact the fasteners.

The pusher 116 may include features similar to those as described with respect to the pusher in the incorporated '600 application, in accordance with an embodiment. For example, in one embodiment, the pusher 116 may have a body 30 with a generally U-shaped cross-sectional profile that partially surrounds the runner of the magazine 102 (see, e.g., FIG. 30). The body 30 of the pusher 116 includes a top surface 32 that acts as a cross support and couples the first and second sides 34 together. A width of the body 30, i.e., between the first and second sides 34 is generally larger than a width of the runner of the magazine 102 such that the runner fits between the first and second sides 34. The top surface 32 has a front surface 44 that faces the dispensing or feed direction, i.e., faces the drive channel 114 when the pusher 116 is mounted in the tool 100. Extending from the top surface 32, on an opposite side to that of front surface 44, is an L-shaped arm 36 that includes a mounting hole 38 for receipt of a screw or fastener for mounting the body 30 of the pusher 116 to a roller and/or spring mechanism within the runner. The L-shaped arm 36 is positioned such that it projects into the runner of the magazine 102. Such features are generally known in the art and thus further details are not discussed here.

In accordance with embodiments herein, the pusher 116 and contact trip 136 may be configured to form the lockout assembly for the tool 100. The pusher 116, in accordance with an embodiment, includes at least one pusher lockout surface 40 that is arranged for contact with contact trip 136. Specifically, in one embodiment, the contact trip 136 provided in the housing 104 of the tool 100 includes at least one lock surface 50 (see, e.g., FIGS. 30-43) that is configured to push the pusher 116 via at least one pusher lockout surface 40 away from the drive channel 114 in an opposite direction to the feed direction. Further, when the magazine 102 is empty or nearly empty of fasteners, the at least one pusher lockout surface 40 is configured to move relative to the at least one lock surface 50 of the contact trip 136 to limit movement of the contact trip 136.

In one embodiment, the pusher 116 may have two pusher lockout surfaces 40. In an embodiment, the at least one pusher lockout surface 40 is provided on at least one pusher arm 42 that extends forwardly, in the feed direction, from body 30 of the pusher 116. In one particular embodiment, such as shown in the exemplary illustration of the pusher 116 in FIGS. 27-29, the pusher 116 includes a first arm 42 and a second arm 42, and each arm 42 includes a pusher lockout surface 40 on a forward facing surface thereof. The first arm 42 and the second arm 42 may project away from the sides 34 from a front region of the pusher 116. The first arm 42 and the second arm 42 are offset from the sides 34 in a manner such that a width between the first arm 42 and the second arm 42 is larger than a width between the sides 34. The first arm 42 and the second arm 42 are nested or positioned around the fasteners in the magazine 102 when the pusher 116 is pushing the fasteners toward the dispensing end and drive channel 114 of the tool 100. Accordingly, the two pusher lockout surfaces 40 may be positioned on either side of the magazine 102.

In an embodiment, a lateral dimension (or lateral inner width) PBL (see FIG. 28) from an inner surface of a first side 34 to an inner surface of a second side 34 is approximately 17.50 mm to approximately 17.90 mm. In accordance with one embodiment, the lateral dimension PBL is approximately 17.72 mm. In an embodiment, a lateral dimension (or lateral outer width) PLL (see FIG. 28) from an outer surface of the first arm 42 to an outer surface of the second arm 42 is approximately 23.90 mm to approximately 24.30 mm. In accordance with one embodiment, the lateral dimension PLL is approximately 24.10 mm.

The at least one pusher lockout surface 40 of the pusher 116 has a leading edge 46, a lower locking surface 48, and a top surface 49 that is opposite the lower locking surface 48, as shown in FIG. 29, for example. In an embodiment, the leading edge 46 is positioned for contact with the at least one lock surface 50 of the contact trip 136 (see, e.g., FIGS. 40-43) as the contact trip 136 moves to its rest position, and the lower locking surface 48 is configured for positioning over the at least one lock surface 50 of the contact trip 136 (see, e.g., FIGS. 35-36) when the magazine is empty or nearly empty of fasteners. In an embodiment, the at least one lock surface 50 of the contact trip 136 extends substantially laterally relative to a body of the contact trip member 136 and its direction (axis) of movement. Such features are further described below with reference to FIGS. 35-47.

In an embodiment, the leading edge 46 of each pusher lockout surface 40 includes an inclined surface or a ramped surface, such as shown in FIG. 29. The inclined or ramped surface on the edge 46 is designed to allow for clearance with respect to the at least one lock surface 50 of the contact trip 136 when the pusher 116 advances a fastener F (or staple) into the drive channel 114 (which takes place once the driver blade 120 is moved out of the way of blocking or limiting movement of a lead fastener into the drive channel 114). That is, the inclined or ramped surface on the pusher lockout surface 40 does not interfere or prevent the pusher 116 from advancing a fastener into the drive channel 114 since the incline is configured in such a manner that the pusher lockout surface 40 is not limited by of the contact trip 136 when the contact trip 136 is in an enabled position. The inclined or ramped surface on the edge 46 is also designed to interface with the at least one lock surface 50 of the contact trip 136 during movement of the contact trip 136 to its resting position. Specifically, the pusher 116 is moved in the opposite direction away from the drive channel 114 (i.e., opposite to the feed direction) via an interfacing of the inclined surface or ramped surface of edge 46 with the at least one lock surface 50 of the contact trip 136 during movement of the contract trip 136 to the resting position. The inclined or ramped surface of edge 46 includes a top corner 56 (at or near top surface 49) and a bottom corner 58 (at or near lower locking surface 48). As seen in FIG. 29, in an embodiment, when the pusher 116 is viewed from the side (or viewed from Z-direction), the top corner 56 is offset longitudinally (along Y-axis) such that the top corner 56 is positioned behind the bottom corner 58. That is, the inclined surface or ramped surface of edge 46 is angled relatively away from the feed direction of the pusher 116, in accordance with an embodiment. In accordance with an embodiment, the inclined surface or ramped surface is positioned at an angle SA of approximately 30+/−5 degrees relative to an axis (X-axis) along which the contact trip 136 moves. In accordance with another embodiment, the inclined surface or ramped surface is positioned at an angle SA2 of approximately 60+/−5 degrees relative to the lower locking surface 48 of the pusher 116. In accordance with yet another embodiment, the inclined surface or ramped surface is positioned at an angle SA3 of approximately 120+/−5 degrees relative to an axis (Y-axis) along which the pusher 116 moves. In an embodiment, the radius of curvature ARC of the bottom corner of the inclined or ramped surface is approximately 0.50+/−0.20 mm.

In an embodiment, each lower locking surface 48 has a longitudinal dimension LSW, extending between front surface 44 and bottom corner 58, of approximately 12.50+/−0.40 mm. In one embodiment, each lower locking surface 48 has a longitudinal dimension LSW of approximately 12.13 mm. In an embodiment, each arm has an axial length AAL, extending between top surface 49 and lower locking surface 48, of approximately 6.50+/−0.40 mm.

The at least one lock surface 50 of the contact trip 136 has at least a top edge 60 and a bottom edge 62 (see FIG. 33), in accordance with an embodiment. Each lock surface 50 also has a front face 64 (e.g., see FIG. 30) and a back face 66 (e.g., see FIG. 35). The top edge 60 is designed to cooperate with lower locking surface 48 of the pusher 116 (see FIGS. 46-47) to limit movement of the contact trip 136, for example, during lockout, such as when the magazine 102 is empty or nearly empty of fasteners. The bottom edge 62 and back face 66 are designed to interface with the inclined surface or ramped surface of edge 46, such that the edge 46 moves along the bottom edge 62 as the contact trip 136 moves to its resting position.

Figure 30:
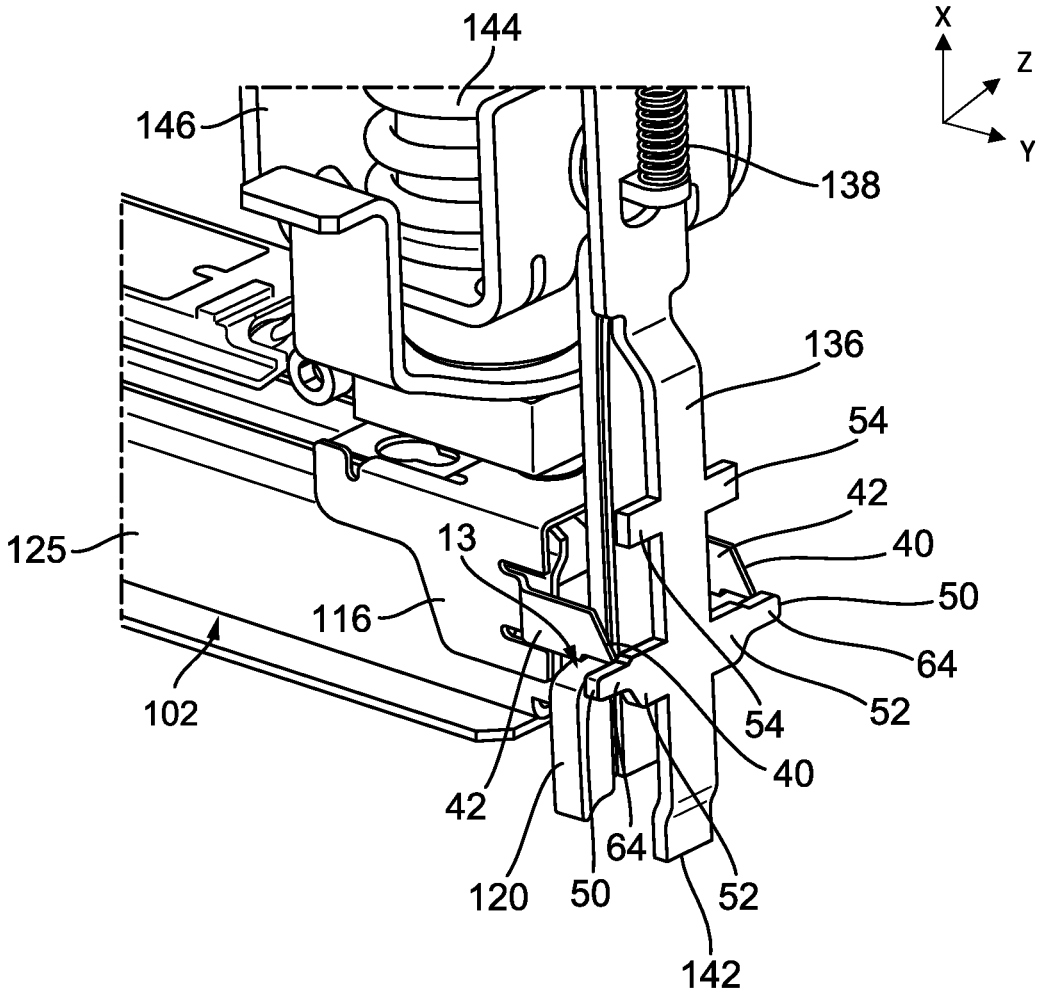
FIG. 30 is an enlarged view of the magazine, pusher, driver blade, and contact trip of an exemplary fastening tool constructed in accordance with teachings of the present disclosure and showing a dry-fire lockout assembly.
Figure 32:
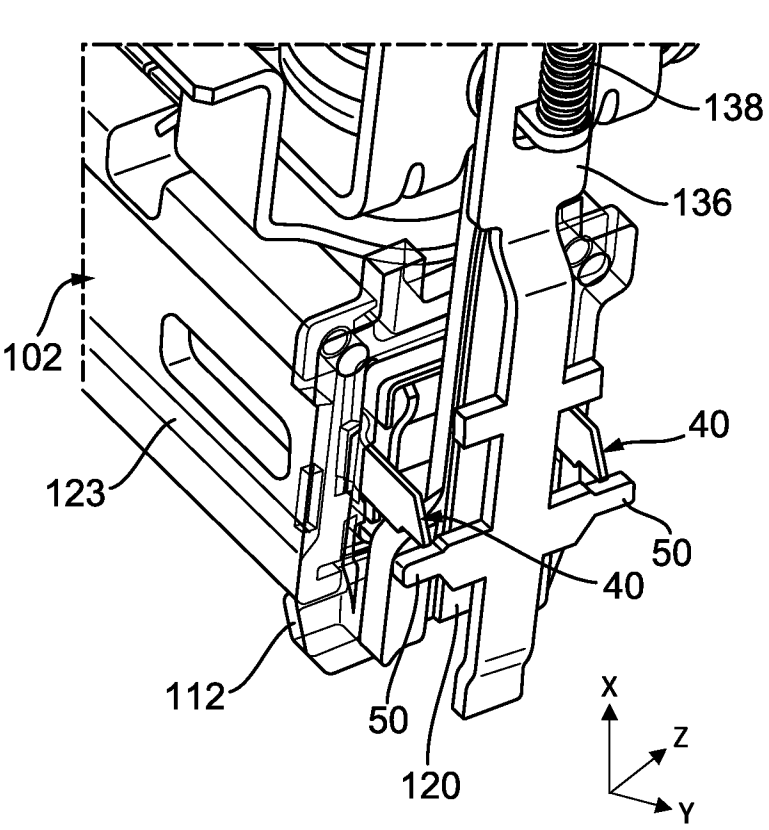
FIGS. 31 and 32 illustrate alternate views of the features as shown in FIG. 30, as well as additional features provided in the tool in accordance with an embodiment.
Figure 31:
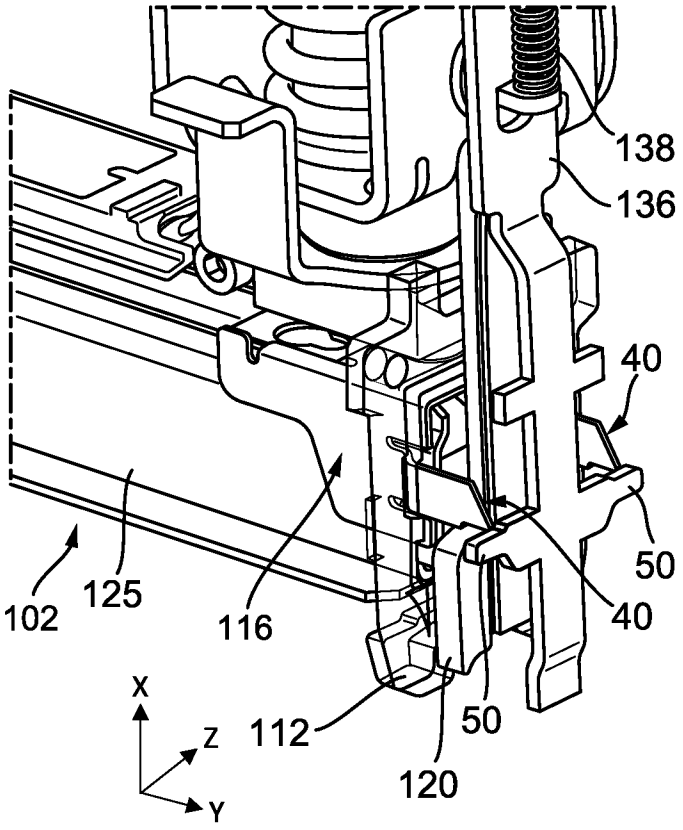
Figure 33:
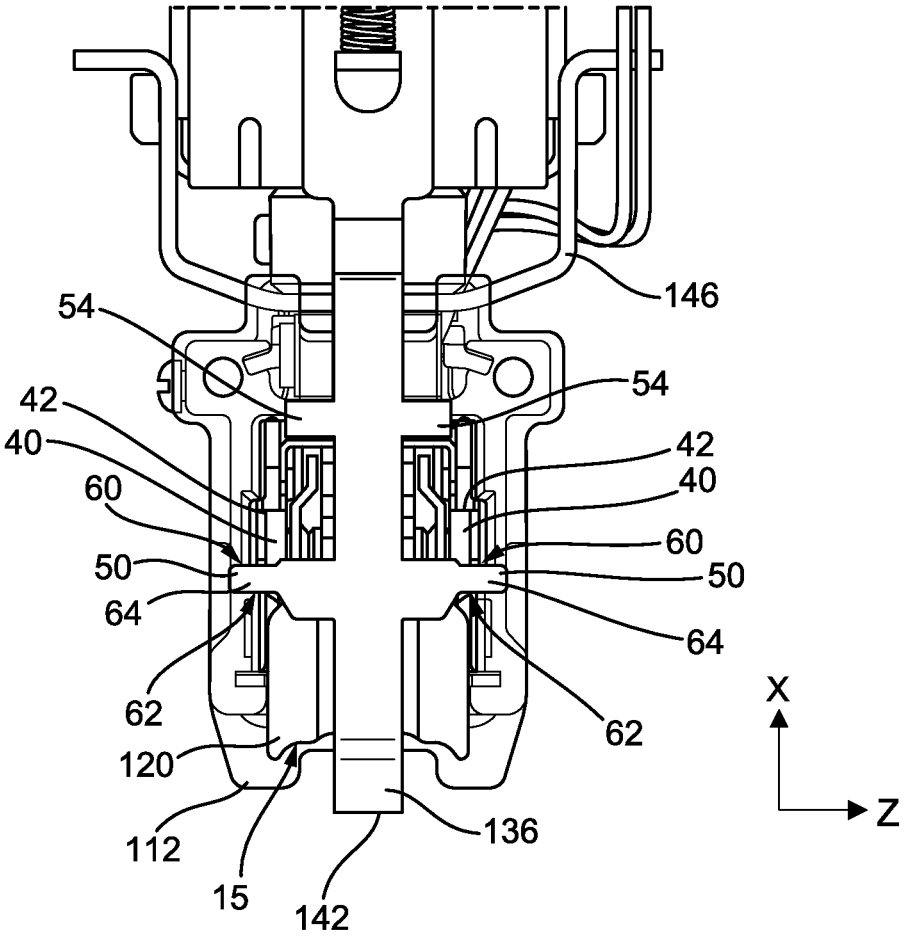
FIG. 33 is a front view of the nose, driver blade, and contact trip in the tool provided in the tool in accordance with an embodiment.

In an embodiment wherein the pusher 116 includes two lockout surfaces 40, e.g., on arms 42, the contact trip 136 may also include two lock surfaces 50. In one embodiment, the contact trip 136 includes a pair of lockout arms 52 that extend laterally relative to the contact trip member 136, such as shown in FIGS. 31-32. The lock surfaces 50 may be provided on or as an extending part of the lockout arms 52. The lock surfaces 50 and lockout arms 52 are separate from and positioned axially below guide arms 54 on the body of the contact trip 136, as shown in FIG. 30, for example.

According to one embodiment herein, the longitudinal dimension LSW of the lower locking surfaces 48, or an overall length of the arms 42, provides the mechanical mechanism used to determine activation of the lockout assembly. In an embodiment, the length of the arms 42/surfaces 48 is proportional to and determines a relative number (e.g., zero or close to zero) of fasteners that may remain in the magazine 102 before lockout. In one embodiment, the dimension LSW/length of arms 42 is configured such that the lockout is initiated after a last fastener is deployed or driven from the tool, i.e., there are zero fasteners remaining in the magazine 102. In another embodiment, the dimension LSW/length of arms 42 is configured such that the lockout is initiated after a smaller number of fasteners, or close to zero, remain in the magazine 102. In one embodiment, these features may be dimensioned such that lockout is initiated when less than ten fasteners are provided in the magazine. In an embodiment, these features may be dimensioned such that lockout is initiated when three to five fasteners are provided in the magazine. Accordingly, the initiation of lockout may be adjustable based on the dimensions of the arms 42/lower locking surfaces 48 of the pusher lockout surfaces 40.

FIGS. 35-47 illustrate detailed views of features in the front end 103 of the tool 100 to show steps and operations of the lockout assembly when using tool 100, e.g., to fasten a cable C to a workpiece W. In this illustrated example, the pusher 116 includes two lockout surfaces 40 provided on a pair of pusher arms 42 extending from the pusher body. Also, in this illustrated example the contact trip 136 has two lock surfaces 50 that extend laterally on either side of the contact trip body. The lock surfaces 50 are provided on a pair of laterally extending lockout arms 52. Such features are exemplary only and not intended to be limiting. That is, in accordance with embodiments as described above, a single pusher lockout surface 40 and a single lock surface 50 may be utilized and perform similar actions as described below.

As previously described, the pusher 116 is spring loaded and exerts pushing force onto a lead fastener F in the magazine 102. In the illustrations of FIGS. 35-47, this lead fastener F is the last fastener in the magazine 102. However, as mentioned previously, the lockout assembly may also be utilized when only a small number of fasteners remain in the magazine.

Figure 35:
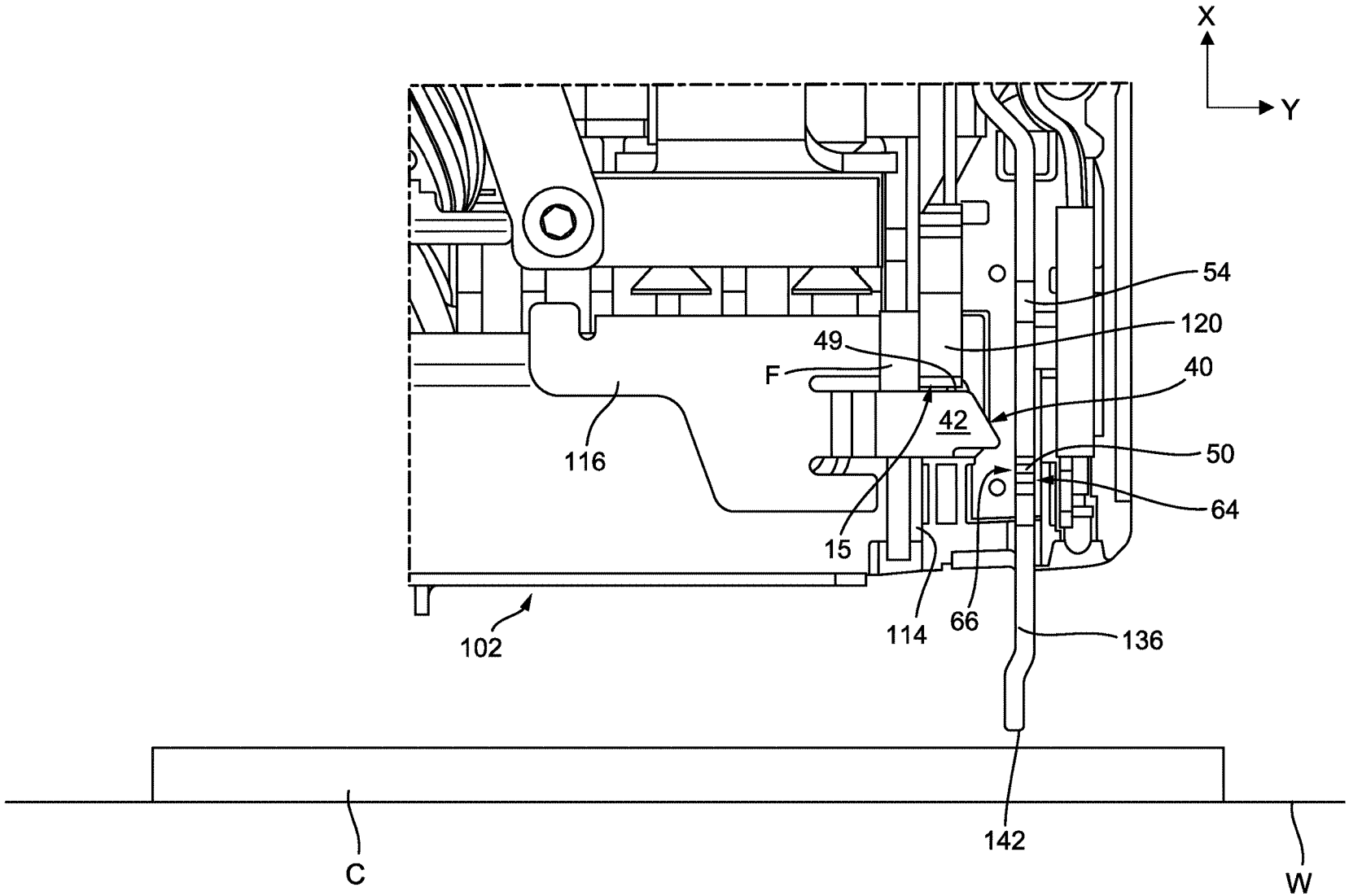
FIGS. 35-45 illustrate operation of the dry-fire lockout assembly when there are no staples and/or a limited number of staples remaining in the magazine.

As shown in FIG. 35, in the rest position of the tool 100 before applying the tool 100 to workpiece W, the fastener F is prevented from entering the drive channel 114 by the stationary driver blade 120. That is, the arms 42 and lockout surfaces 40 of the pusher 116 extend into the drive channel 114. Further, in a rest position of the tool 100, the driver blade 120 is stationary (switch 148 is closed). The contact trip 136 is also in its at rest or normal position; i.e., extended from the housing and in a position that limits activation of the motor 130.

Figure 36:
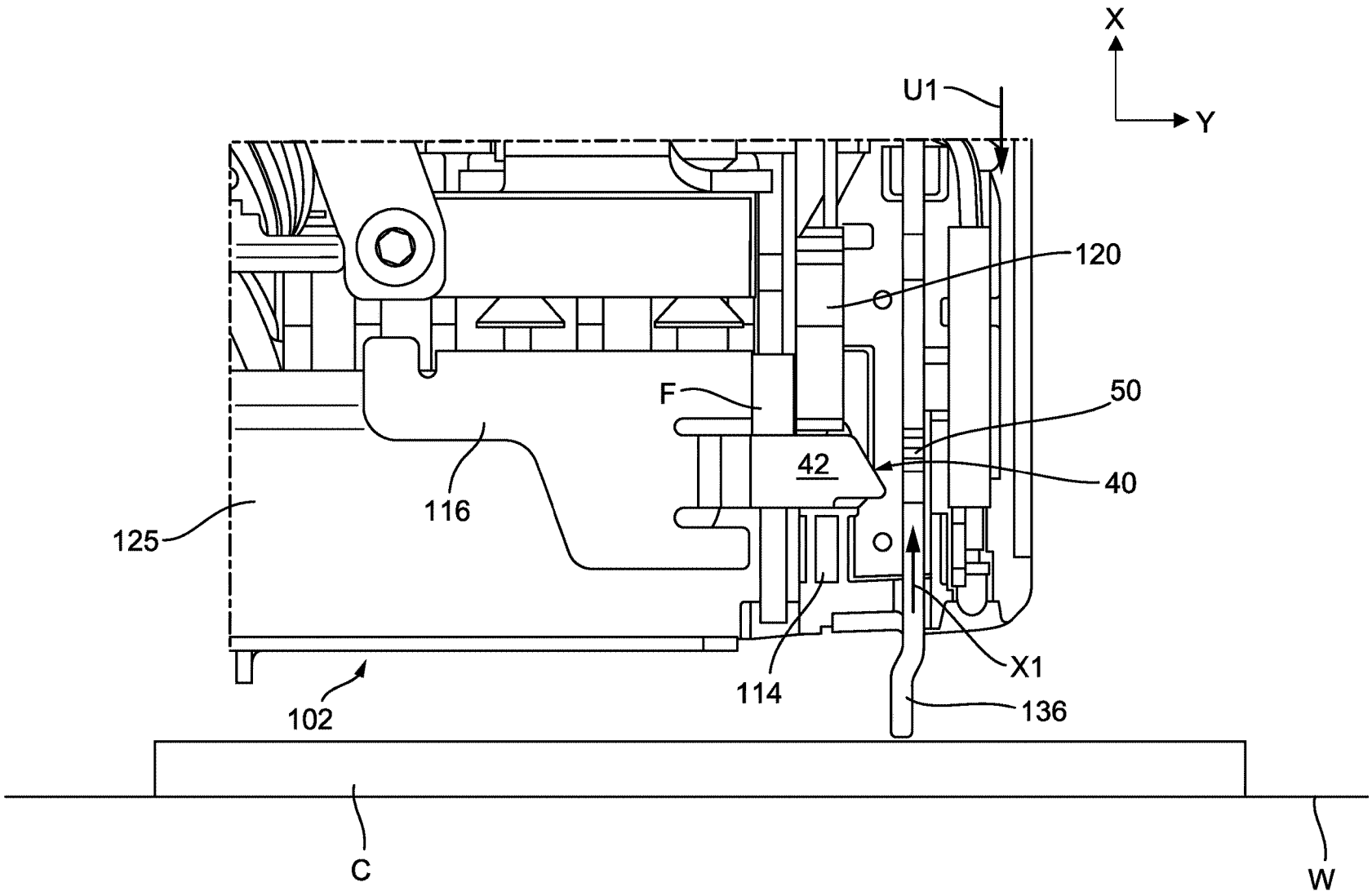
Figure 37:
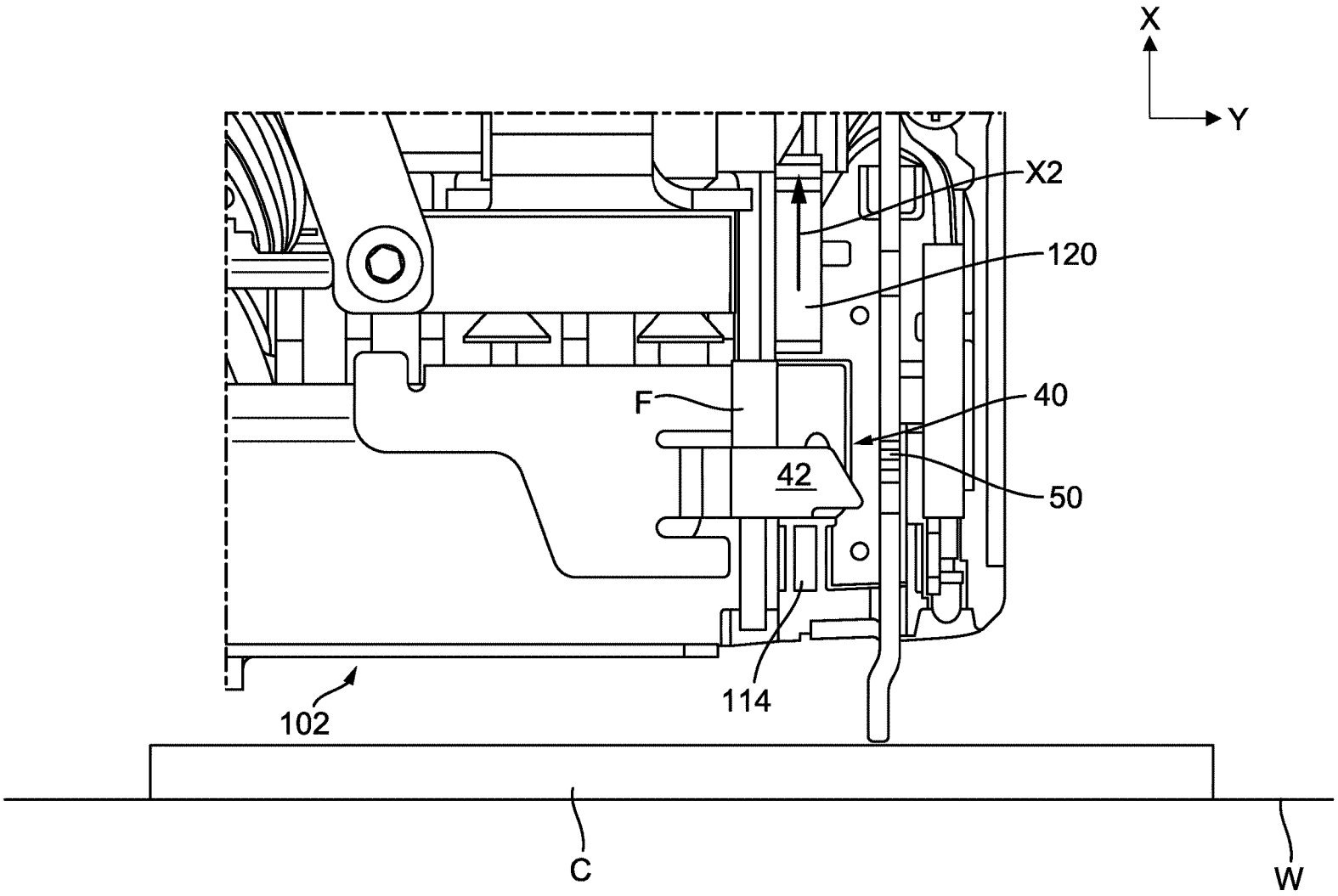
Figure 38:
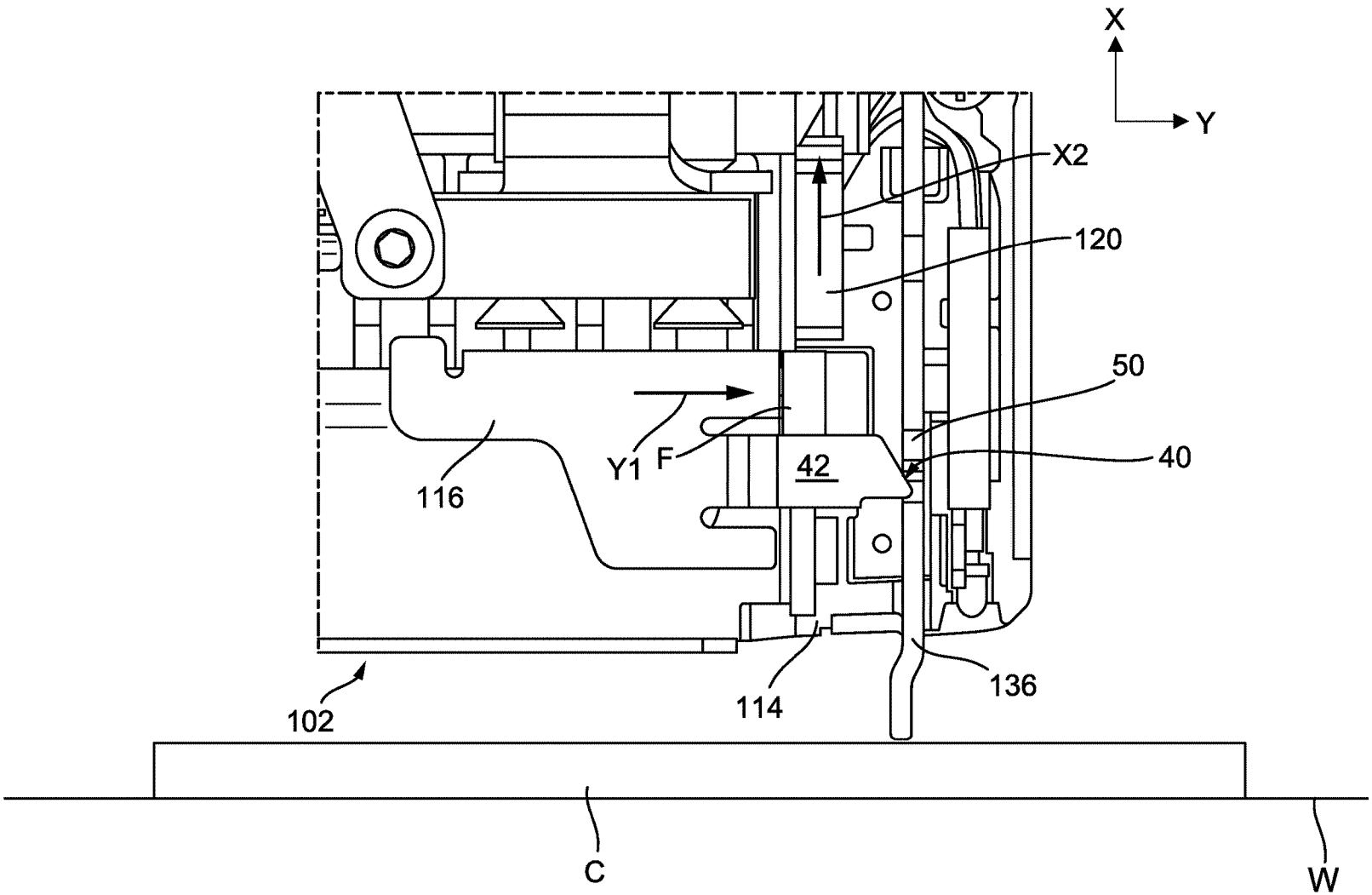

During use, such as shown in FIG. 36, the tool 100 is biased in a generally downward direction towards cable C and workpiece W by an operator, as indicated by arrow U1, until the contact trip 136 is pushed upwards into tool, as indicated by arrow X1. As the contact trip 136 is moved axially or vertically within the housing in the X1 direction, to an enabled position, the contact trip assembly 124 is activated (e.g., by way of compressing spring 138 and tripping/closing the trip switch 140) which places the tool 100 in a ready state and allows activation of the motor 130 (via pulling of trigger 108). The lock surfaces 50 of the contact trip 136 move with the contact trip 136. The contact trip 136 should be pressed against the cable C when the trigger is pulled, as shown in FIG. 36, in order to ready and then activate the motor 130 and power unit 110 and drive fastener F into the workpiece W. When the operator pulls the trigger 108, the driver blade 120 moves upwardly within the drive channel 114, as indicated by arrow X2 and shown in FIG. 37, and opens the drive channel 114. Then, as shown in FIG. 38, with the driver blade 120 moving up axially, and out of the way of blocking or limiting movement of a lead fastener into the drive channel 114, the spring force exerted on the pusher 116 is configured to advance the lead fastener F into the drive channel 114 as the pusher 116 moves in the feed direction as indicated by arrow Y1. The leading edges 46 of the pusher lockout surfaces 40 are in contact with/against, i.e., interfacing with, a portion of the lock surfaces 50. The leading edges 46 of the lockout surfaces 40, which are angled and/or has an inclined or ramped surface as previously described, allows clearance with respect to the contact trip lock surfaces 50, that would otherwise interfere and prevent pusher 116 from advancing the fastener F. As shown in FIG. 38, for example, at least bottom corners 58 and/or part of the edges 46 of the pusher lockout surfaces 40 may be positioned below the bottom edges 62 of the lock surfaces 50 of the contact trip 136 as the pusher 116 is moved to interface with the contact trip 136. Accordingly, there is no interference with regards to the pusher 116 being able to advance the fastener F in the feed direction.

Figure 39:
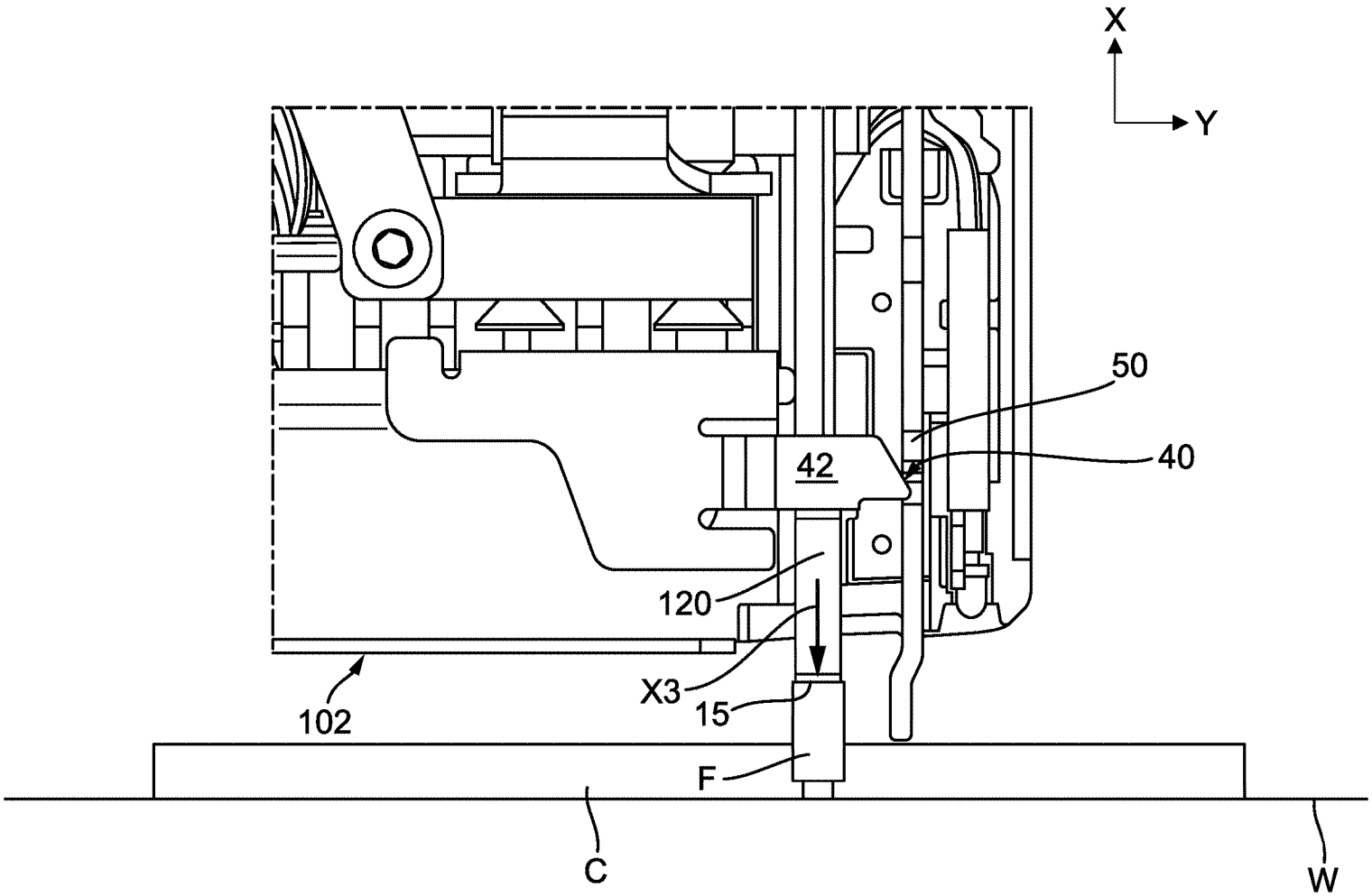

Thereafter, as shown in FIG. 39, the driver blade 120 is able (via power unit 110) to move axially (downward), as indicated by arrow X3, to drive the fastener F towards and into the workpiece W via its driving edge 15, thereby securing the cable C. During this action, as shown in FIG. 39, the pusher 116 remains spring-loaded towards the drive channel 114 and feed direction, and thus the inclined surface or ramped surface of each of the lockout surfaces 40 remains interfaced with the lock surfaces 50.

Figure 41:
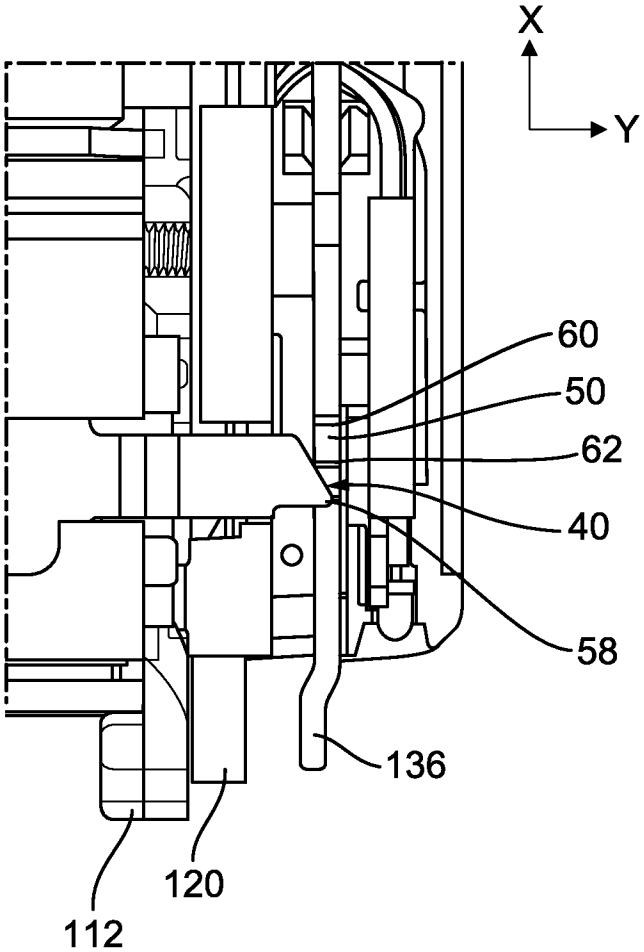
Figure 40:
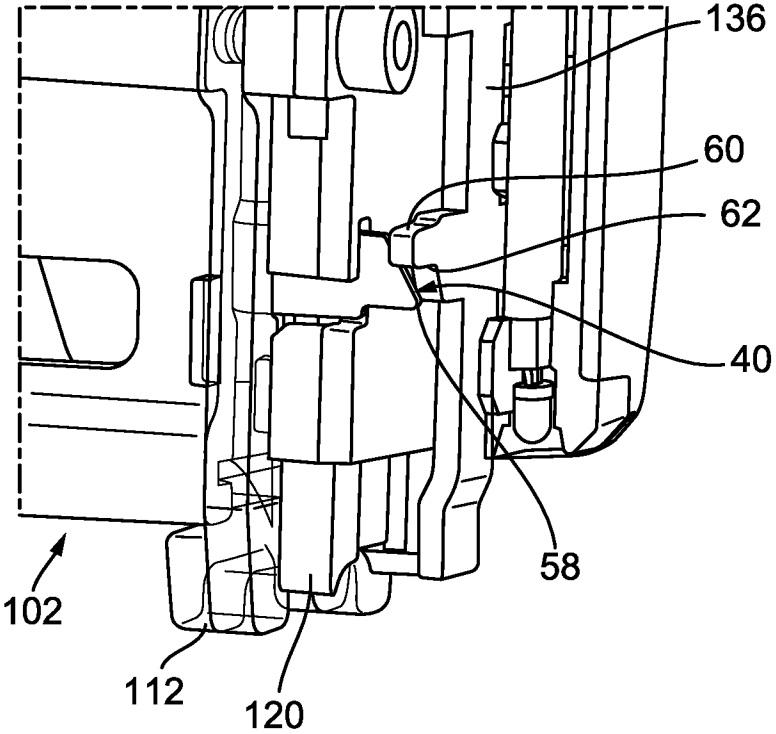

FIGS. 40 and 41 show further views and details of the interface between the leading edges 46 of the pusher lockout surfaces 40 with a portion of the lock surfaces 50. As shown, the edge 46 of the pusher lockout surface(s) 40 remain in contact with at least the bottom edges 62 of the lock surfaces 50, since the pusher 116 remains spring-loaded towards the drive channel 114 and feed direction. The bottom corner 58 and/or part of the edge 46 of the pusher lockout surface(s) 40 may extend below the bottom edges 62 of the lock surfaces 50. The top corners 56 of the lockout surfaces 40 are positioned relatively behind the lock surfaces 50, behind the back faces 66, during the interfacing of the pusher 116 and contact trip 136.

Figure 42:
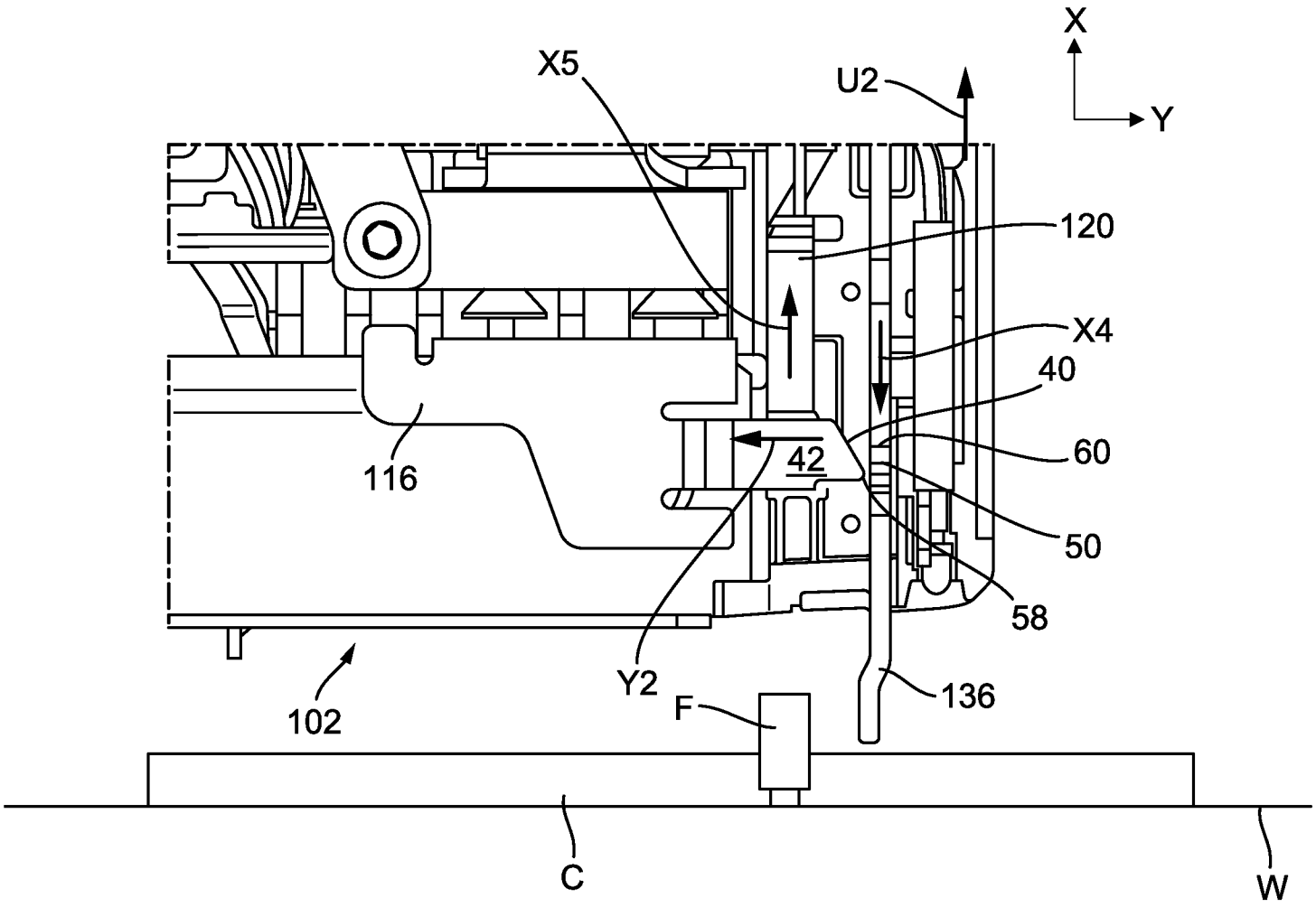
Figure 43:
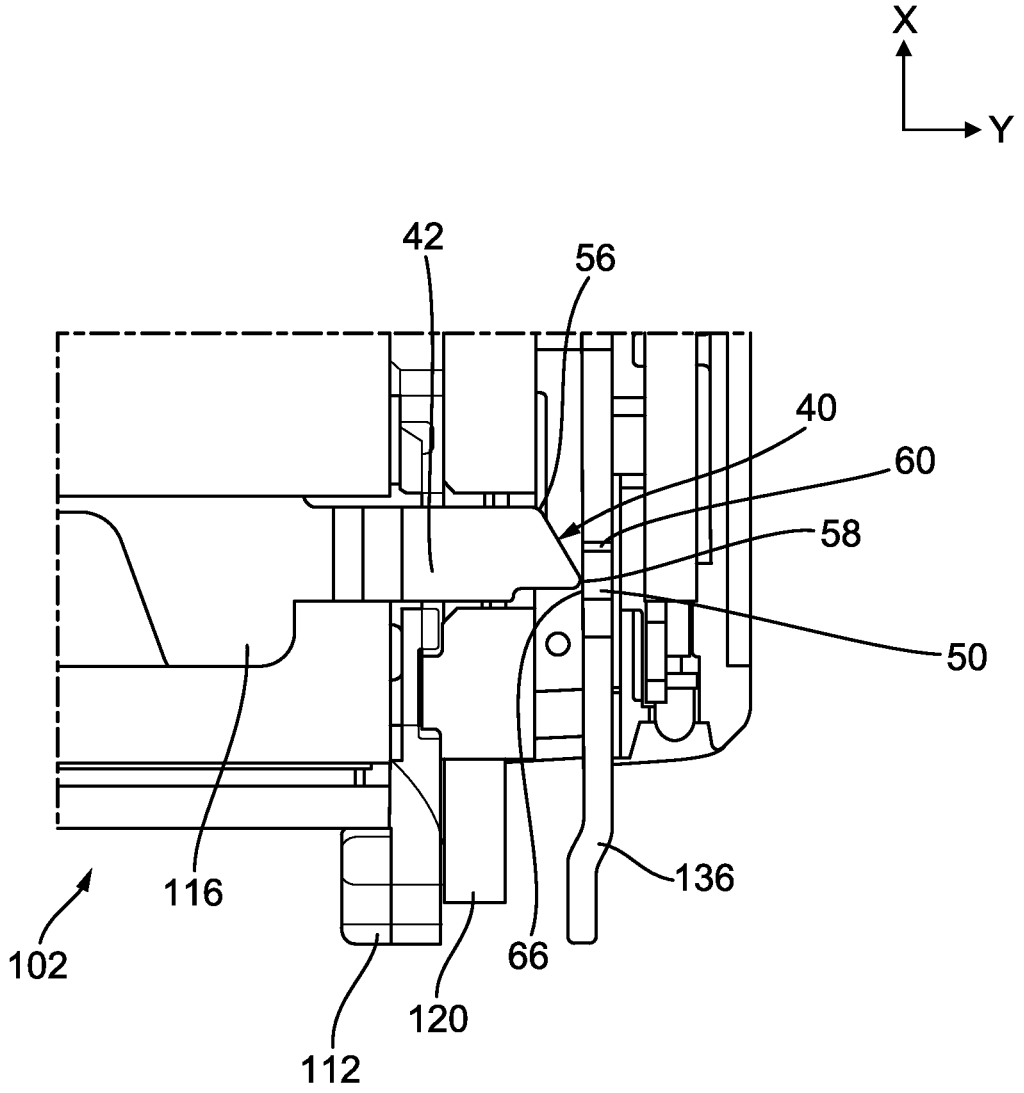

After the fastener F is driven into the workpiece W, the tool 100 is typically moved or lifted away from the workpiece W manually by the operator, such as indicated by arrow U2 in FIG. 42. As this happens, the body of contact trip 136, driven by a force from its spring 138, will move axially down towards its resting position, as indicated by arrow X4. As shown in FIG. 42, during movement of the contact trip 136 to its rest position, the pusher lockout surfaces 40 are forced to move along back faces 66 of the lock surfaces 50, such that the pusher 116 is moved backwards longitudinally, i.e., in an opposite direction to the feed direction, and out of the way, as indicated by arrow Y2 in FIG. 42. This is due to the angled or ramped surface of the lockout surfaces 40 of the pusher 116 interfacing with a surface of the lockout arms of the contact trip 136. Specifically, the leading edges 46 of the lockout surfaces 40 are guided along bottom edges 62 and then along back faces 66 of the lock surfaces 50, as shown in FIG. 43, as the contact trip 136 continues to move axially downward. This clears the way for the lock surfaces 50 and locking arms 52 of the contact trip 136 to move with the contact trip 136 back to the contact trip resting position. The driver blade 120 also moves axially upward and away from the magazine 102, as indicated by arrow X5 in FIG. 42, to its rest position.

Figure 44:
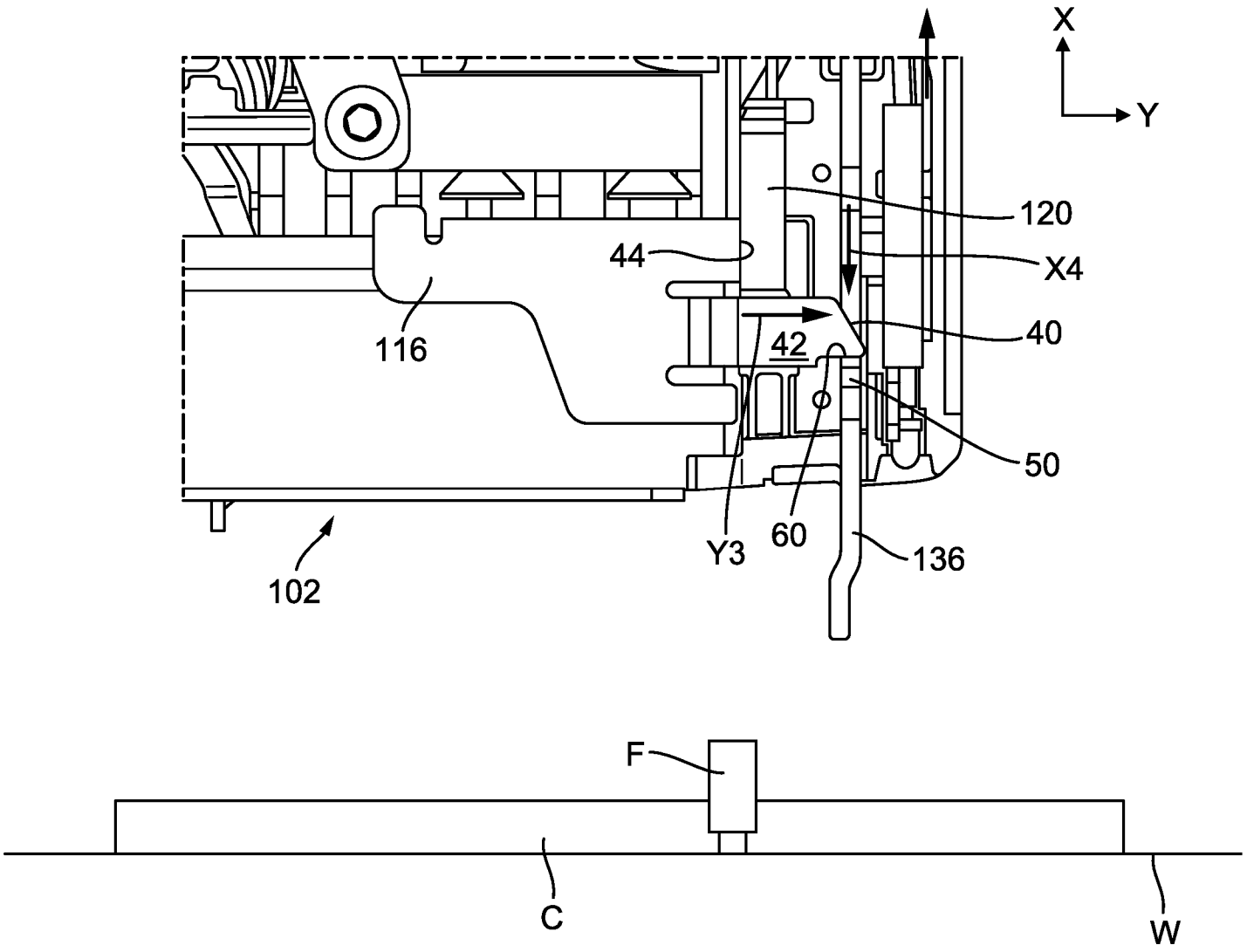
Figure 46:
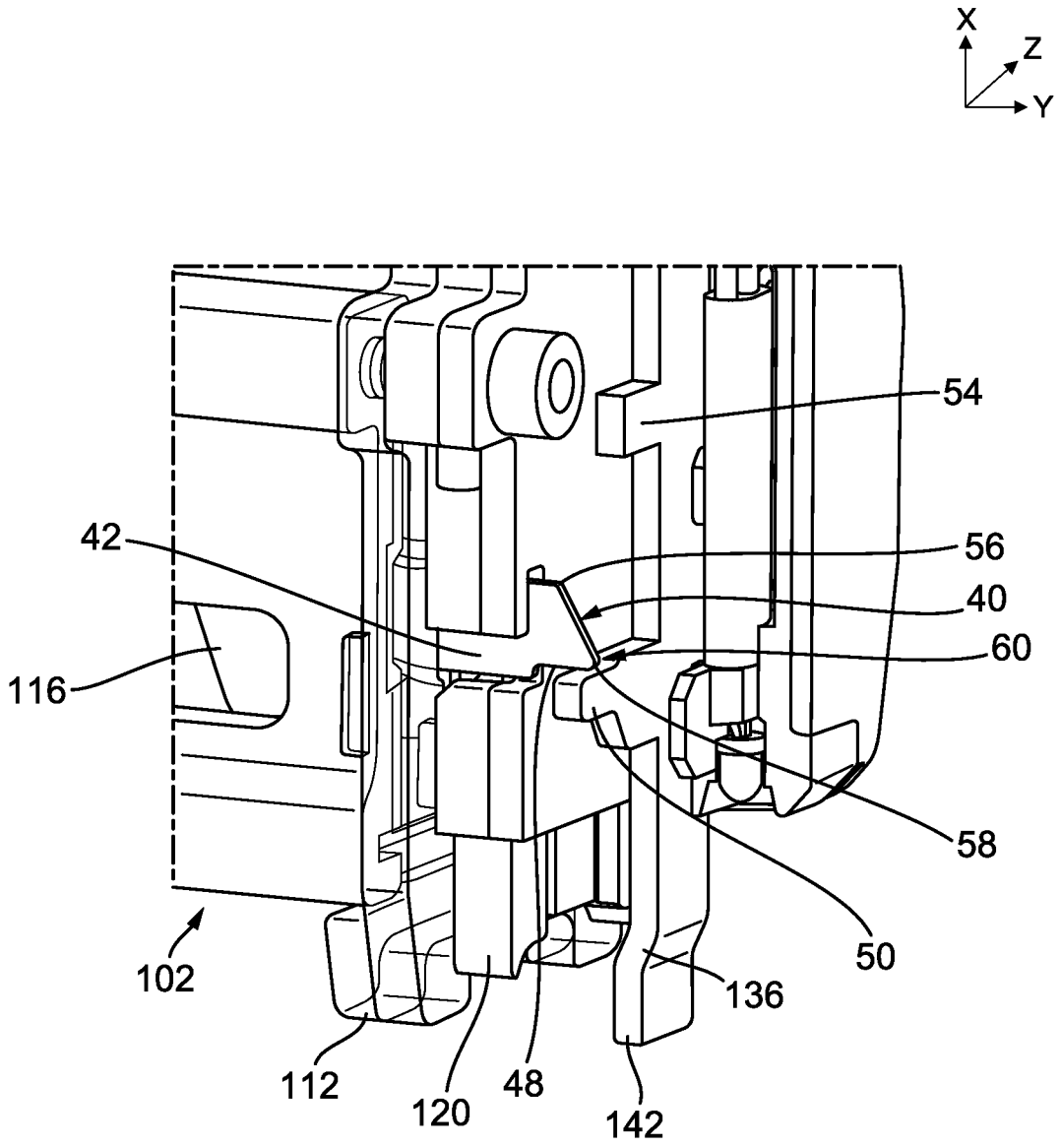
FIGS. 46-47 illustrate additional features of the magazine, pusher and nosepiece assembly of the fastening tool of FIG. 1.
Figure 47:
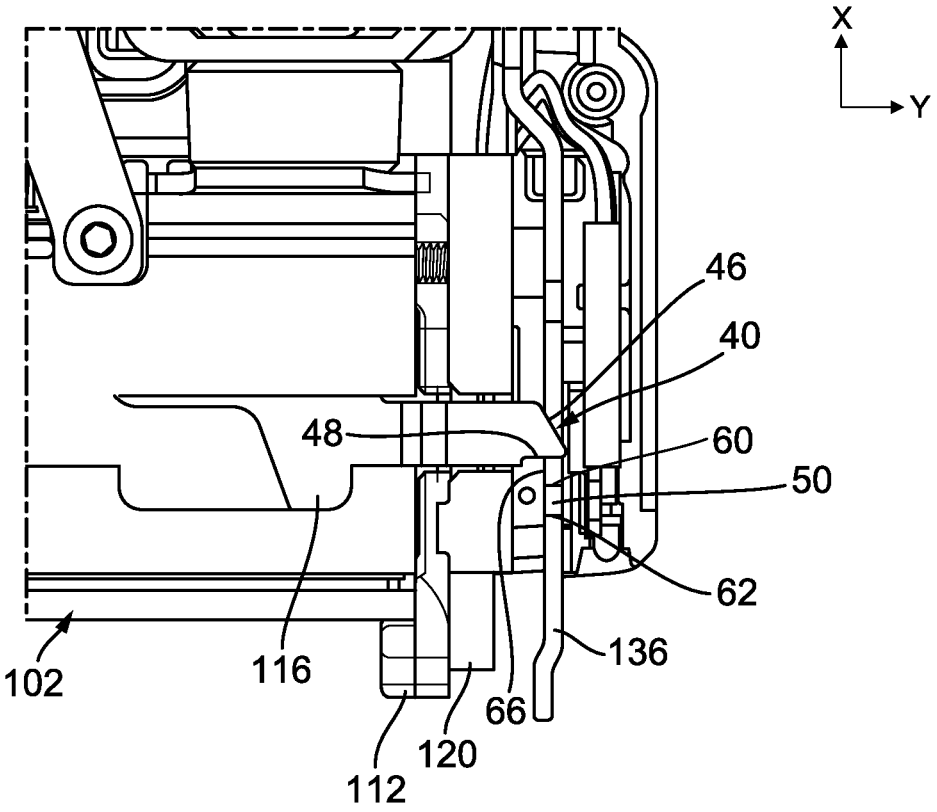

As the contact trip member 136 travels to its rest position, edges 46 of the pusher lockout surfaces 40 are guided along the back faces 66 towards top edges 60 of the lock arms 50. When the magazine 102 is empty or nearly empty of fasteners, the pusher lockout surfaces 40 are then further guided thereover the top edges 60 of the lock arms 50, as shown in FIG. 44. (Otherwise, the pusher 116 may be simply moved backwards such that the pusher 116 is set up to drive a new lead fastener, similar to the features shown in FIG. 36, and tool 100 could be utilized to drive another fastener.) Once contact trip 136 reaches its resting position, as shown in FIG. 44 and in greater detail in FIGS. 46-47, the lock surfaces 50 (and lockout arms 52) of the contact trip 136 have moved down past the pusher lockout surfaces 40. This allows the spring force on the pusher 116 to move the pusher arm(s) 42 and pusher lockout surfaces 40 forward in the feed direction, as indicated by arrow Y3, until the pusher 116 is stopped by the at-rest driver blade 120 through contact of the front surface 44 of the pusher 116 with the back of the driver blade 120, also shown in FIG. 44. The pusher arm(s) 42 and pusher lockout surfaces 40 of the pusher 116 slide over the lock surfaces 50 of the contact trip 136, as seen in FIGS. 46 and 47, thereby preventing the contact trip 136 from being able to advance to its enabled position and back up into the housing if pressed against the cable C. In particular, the lower locking surfaces 48 slide over and remain in contact with the top edges 60 of the lock arms 50, thereby preventing movement of the contact trip 136.

Figure 45:
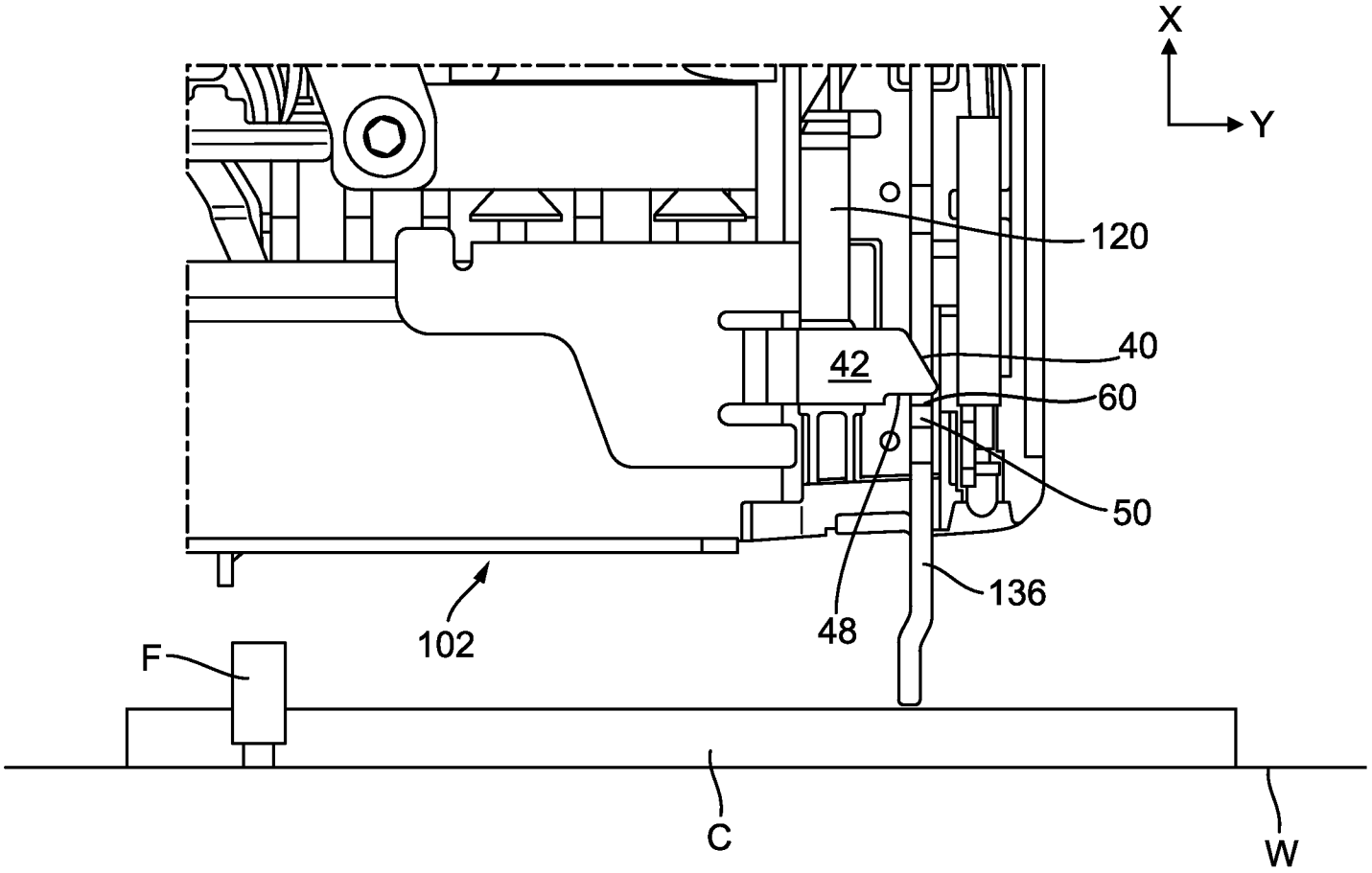

If an operator tries to use the tool 100 to drive another fastener F, in particular while the magazine 102 is empty (or nearly empty) of fasteners, and presses the contact trip 136 against the cable C and/or workpiece W, such as shown in FIG. 45, the contact trip 136 is prevented from moving up into the housing 104 of the tool 100 by the pusher lockout surfaces 40 and pusher arm(s) 42. As previously described, the contact trip arm 136 interfaces with trip switch 140. Because of the placement of the pusher 116 over the contact trip 136, the trip switch 140 can no longer be closed or actuated. When the operator pulls the trigger 108, the motor 130 and mechanisms in the tool 100 will not actuate.

In an embodiment, the tool is "locked out" and remains locked until the user loads more fasteners into the magazine 102 of the tool 100.

Accordingly, both the driver blade 120 and contact trip 136 may be locked from moving during a lockout condition as described with respect to FIGS. 35-47. This prevents drive energy from being generated by the tool when no staple is present to absorb the energy. This removes potential for damaging the cable C and/or tool 100 by the driver blade 120 being released without driving a fastener. As such, the cable can be protected. As a result of the tool not expending energy, the life of the tool may also be extended. In addition, the lockout assembly as disclosed herein also allows the driver blade 120 to be positioned within the feeding channel or drive channel 114. With the driver blade 120 within the drive/feeding channel, an errant fastener is blocked from entering the drive path without the trigger being pulled. As a result, accidental firing of an errant fastener/staple can be prevented. Thus, this provides an additional safety feature in tool 100.

In one embodiment, every fastener in magazine 102 may be fired from fastening tool 100. After the last fastener is fired from the tool 100, the tool is locked so that the mechanisms cannot be actuated.

For illustrative and explanatory purposes only, in FIGS. 30-47, parts associated with, or that are part of, the magazine (e.g., track) may be referred to collectively as being the magazine 102. However, it should be clear to one of ordinary skill in the art that parts of the magazine 102 (e.g., track, frame, runner, etc.) may or may not be illustrated in order to more clearly show features and placement of the pusher 116 with respect to the magazine 102.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment, or different embodiments. Further, the particular features, structures or characteristics may be combined in any suitable manner in one or more embodiments. Further, it is intended that embodiments of the disclosed subject matter cover modifications and variations thereof.

While aspects of this disclosure are described herein and illustrated in the accompanying drawings in the context of fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made, and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

What is claimed is:

1. A tool comprising:

a housing;

a magazine carried by the housing, the magazine configured to hold a plurality of fasteners and configured to present a lead fastener of the plurality of fasteners into a drive channel;

a driver blade provided in the housing and configured for movement within the drive channel to drive the lead fastener into a workpiece;

a drive system configured to drive the movement of the driver blade;

the driver blade having a driving edge configured for contact with the lead fastener, the driving edge comprising:

a central portion and a pair of driving projections on opposite sides of the central portion, the pair of driving projections configured for contact with spaced curved edges of opposite sides of the lead fastener above legs of the lead fastener, each of the driving projections extending downwardly from the central portion and having a concave driving contact surface with a concave curvature, the concave driving contact surfaces being configured to contact the curved edges of the lead fastener, and the central portion comprising a relief portion provided between the pair of driving projections, the relief portion comprising a length that is centered relative to the driving edge and the relief portion being recessed and concave relative to both of the pair of driving contact surfaces and the pair of driving projections so as to provide a non-contact surface with respect to the lead fastener.

2. The tool according to claim 1, wherein the relief portion is centered in a lateral direction relative to the pair of driving projections of the driver blade.

3. The tool according to claim 2, wherein a center of the relief portion is provided at an axial length of 2.9+/−0.4 mm from a plane positioned across bottom edges of the pair of driving projections.

4. The tool according to claim 1, wherein the driving edge comprises a ratio of non-contact surface length to contact surface length in a range of approximately 1.1 to approximately 1.8.

5. The tool according to claim 1, wherein a radius of curvature of the driving contact surfaces is approximately 2.5 mm to approximately 3.1 mm.

6. The tool according to claim 1, wherein, in a lateral direction of the driver blade when the driver blade is provided in the housing, the concave curvature of each of the driving contact surfaces has a lower end further away from the relief portion and a higher end closest to the relief portion.

7. The tool according to claim 6, wherein an axial length between the higher end of the concave curvature to a plane positioned across bottom edges of the pair of driving projections is 1.9+/−0.2 mm.

8. The tool according to claim 6, wherein an axial length between the higher end of the concave curvature to a plane positioned across a center of the relief portion is 1.0+/−0.2 mm.

9. The tool according to claim 6, wherein a lateral length between the higher end of the concave curvature to an outer edge of the driving projection is approximately 5.2 mm to approximately 5.6 mm.

10. The tool according to claim 6, wherein transition surfaces are provided on the driving edge of the driver blade between the higher ends of the driving contact surfaces and the relief portion, and wherein the transition surfaces are curved.

11. The tool according to claim 10, wherein each of the transition surfaces comprises a radius of curvature of approximately 0.3 mm to approximately 0.7 mm.

12. The tool according to claim 1, wherein each driving projection has a lateral length of approximately 1.0 mm to approximately 1.4 mm.

13. The tool according to claim 1, wherein each driving projection has a bottom edge comprising a radius of curvature of approximately 0.30 mm to approximately 0.70 mm.

14. A tool comprising:

a housing;

a magazine carried by the housing, the magazine configured to hold a plurality of fasteners and configured to present a lead fastener of the plurality of fasteners into a drive channel;

a driver blade provided in the housing and configured for movement within the drive channel to drive the lead fastener into a workpiece;

a drive system configured to drive the movement of the driver blade;

the driver blade having a driving edge configured for contact with the lead fastener, the driving edge comprising:

a central portion;

a pair of driving projections on opposite sides of the central portion, each driving projection configured for contact with a curved edge on either side of the lead fastener above legs of the lead fastener;

each driving projection extending downwardly from the central portion and having a driving contact surface, at least a portion of each of the driving contact surfaces having a concave curvature, the driving contact surfaces being configured to contact the curved edges of the lead fastener; and the central portion comprising a relief portion provided between the pair of driving projections and in a center of the driving edge, the relief portion being recessed and concave relative to both of the driving contact surfaces and the pair of driving projections so as to provide a non-contact surface with respect to the lead fastener.

15. The tool according to claim 14, wherein the driving contact surfaces are provided on the pair of driving projections.

16. The tool according to claim 14, wherein the center of the relief portion is provided at an axial length of 2.9+/−0.4 mm from a plane positioned across bottom edges of the pair of driving projections.

17. The tool according to claim 14, wherein the driving edge comprises a ratio of non-contact surface length to contact surface length in a range of approximately 1.1 to approximately 1.8.

18. The tool according to claim 14, wherein a radius of curvature of the driving contact surfaces is approximately 2.5 mm to approximately 3.1 mm.

19. The tool according to claim 14, wherein, in a lateral direction of the driver blade when the driver blade is provided in the housing, the concave curvature of each of the driving contact surfaces has a lower end further away from the relief portion and a higher end closest to the relief portion.

20. The tool according to claim 19, wherein an axial length between the higher end of the concave curvature to a plane positioned across bottom edges of the pair of driving projections is 1.9+/−0.2 mm.

* * * * *